US009415846B2

(12) United States Patent
Shupe et al.

(10) Patent No.: US 9,415,846 B2
(45) Date of Patent: Aug. 16, 2016

(54) WAKEBOARD BINDINGS, WAKEBOARDS INCLUDING SUCH BINDINGS, AND RELATED METHODS

(75) Inventors: Eric J. Shupe, Salt Lake City, UT (US); Charles B. Shupe, Layton, UT (US)

(73) Assignee: SHUPERSTAR LLC, Salt Lake City, UT (US)

( * ) Notice: Subject to any disclaimer, the term of this patent is extended or adjusted under 35 U.S.C. 154(b) by 105 days.

(21) Appl. No.: 14/240,673

(22) PCT Filed: Aug. 23, 2012

(86) PCT No.: PCT/US2012/052152

§ 371 (c)(1), (2), (4) Date: Sep. 29, 2014

(87) PCT Pub. No.: WO2013/028918

PCT Pub. Date: Feb. 28, 2013

(65) Prior Publication Data

US 2015/0104987 A1 Apr. 16, 2015

Related U.S. Application Data

(60) Provisional application No. 61/526,332, filed on Aug. 23, 2011.

(51) Int. Cl.
*B63B 35/81* (2006.01)
*A63C 10/10* (2012.01)

(52) U.S. Cl.
CPC ..... *B63B 35/812* (2013.01); *A63C 10/106* (2013.01); *B63B 2035/818* (2013.01); *Y10T 29/49826* (2015.01)

(58) Field of Classification Search
CPC ..... B63B 35/812; B63B 2035/818
USPC ..... 441/70; 280/617–618, 624, 626, 14.22
See application file for complete search history.

(56) References Cited

U.S. PATENT DOCUMENTS 5,810,370 A * 9/1998 Covert ..... A63C 10/04 280/14.24
5,868,416 A 2/1999 Fardie et al.
(Continued)

FOREIGN PATENT DOCUMENTS

GB 2196905 A 5/1988
GB 2197625 A 5/1988
(Continued)

OTHER PUBLICATIONS

PCT International Search Report for PCT/US2012/052152, mailed Dec. 27, 2012.

*Primary Examiner* — Lars A Olson
*Assistant Examiner* — Jovon Hayes
(74) *Attorney, Agent, or Firm* — TraskBritt

(57) ABSTRACT

Wakeboard bindings may comprise a first member configured for connection to a wakeboard. A selective retaining device comprising at least one retaining member may be connected to and disposed at a periphery of the first member. A second member may be rotatable with respect to the first member and may comprise at least one engagement member. The at least one retaining member may be engaged with the at least one engagement member to preclude rotation of the second member in a rotation-precluding position and may be disengaged from the at least one engagement member to permit rotation of the second member in a rotation-permitting position. A releasable step-in connection device comprising a first connection member and a second connection member biased toward a connection position and movable to a release position may be connected to the second member and configured to releasably connect to a foot restraint.

19 Claims, 10 Drawing Sheets

(56) References Cited

U.S. PATENT DOCUMENTS

| | | | | |
|---|---|---|---|---|
| 5,868,594 | A | 2/1999 | Vukelic et al. | |
| 5,947,508 | A * | 9/1999 | Graf | A63C 10/08 280/613 |
| 6,099,018 | A * | 8/2000 | Maravetz | A43B 5/0401 280/14.24 |
| 6,155,578 | A | 12/2000 | Patterson | |
| 6,257,614 | B1 | 7/2001 | Duggan | |
| 6,293,578 | B1 * | 9/2001 | Anderson | A63C 10/10 280/14.24 |
| 6,315,305 | B1 * | 11/2001 | Gien | A63C 10/22 280/11.26 |
| 6,595,542 | B2 * | 7/2003 | Okajima | A63C 10/10 280/14.22 |
| 6,786,502 | B2 * | 9/2004 | Carlson | A63C 5/128 280/14.22 |
| 6,855,023 | B2 | 2/2005 | Berger | |
| 6,945,544 | B2 * | 9/2005 | Feurer | A63C 10/18 280/14.22 |
| 6,945,837 | B2 * | 9/2005 | Crumrine | B63B 35/812 280/607 |
| 7,090,228 | B2 * | 8/2006 | Reynolds | A63C 10/18 280/14.21 |
| 7,210,252 | B2 | 5/2007 | Morrow et al. | |
| 7,267,357 | B2 | 9/2007 | Miller et al. | |
| 7,281,717 | B2 | 10/2007 | Sacco et al. | |
| 7,287,776 | B2 * | 10/2007 | Papon | A63C 10/20 280/14.22 |
| 7,290,785 | B2 | 11/2007 | Dixon | |
| 7,410,177 | B2 | 8/2008 | Giffin et al. | |
| 7,469,911 | B2 | 12/2008 | Sanders | |
| 7,510,207 | B2 | 3/2009 | Resch et al. | |
| 7,556,280 | B2 | 7/2009 | Holzer | |
| 7,571,924 | B2 | 8/2009 | White | |
| 7,658,398 | B2 | 2/2010 | Panzeri | |
| 7,707,694 | B2 * | 5/2010 | Holzer | A43B 5/0452 24/68 SK |
| 7,758,394 | B2 | 7/2010 | Shaw et al. | |
| 7,762,573 | B2 * | 7/2010 | Zaloom | A63C 5/03 280/611 |
| 7,815,214 | B2 | 10/2010 | Sabol | |
| 7,850,194 | B2 | 12/2010 | Zaloom et al. | |
| 7,887,083 | B2 | 2/2011 | Zaloom et al. | |
| 7,918,477 | B2 | 4/2011 | Wischhusen et al. | |
| 8,104,786 | B2 * | 1/2012 | Fumagalli | A63C 10/26 280/11.36 |
| 9,016,714 | B2 * | 4/2015 | Pelchat | A63C 10/16 280/14.22 |
| 2001/0038182 | A1 * | 11/2001 | Carlson | A63C 5/128 280/14.22 |
| 2002/0153701 | A1 | 10/2002 | Okajima et al. | |
| 2002/0153702 | A1 * | 10/2002 | Okajima | A43B 5/0401 280/613 |
| 2003/0011171 | A1 * | 1/2003 | Battistella | A63C 10/18 280/618 |
| 2005/0040624 | A1 * | 2/2005 | Papon | A63C 10/20 280/636 |
| 2005/0248129 | A1 * | 11/2005 | Pelchat | A63C 5/128 280/629 |
| 2006/0170196 | A1 * | 8/2006 | Couderc | A63C 10/285 280/607 |
| 2006/0237920 | A1 * | 10/2006 | Steere | A63C 10/04 280/11.36 |
| 2007/0029759 | A1 * | 2/2007 | O'Hara | A63C 10/16 280/618 |
| 2007/0138766 | A1 * | 6/2007 | Couderc | A63C 10/22 280/618 |
| 2008/0122202 | A1 * | 5/2008 | Furr | A63C 10/12 280/626 |
| 2008/0309052 | A1 * | 12/2008 | Neiley | A63C 10/18 280/613 |
| 2015/0104987 | A1 * | 4/2015 | Shupe | B63B 35/812 441/70 |

FOREIGN PATENT DOCUMENTS

| | | | |
|---|---|---|---|
| WO | 2007064890 | A1 | 6/2007 |
| WO | 2011028656 | A1 | 3/2011 |

* cited by examiner

WAKEBOARD BINDINGS, WAKEBOARDS INCLUDING SUCH BINDINGS, AND RELATED METHODS

CROSS-REFERENCE TO RELATED APPLICATIONS

This application is a national phase entry under 35 U.S.C. §371 of International Patent Application PCT/US2012/052152, filed Aug. 23, 2012, designating the United States of America and published in English as International Patent Publication WO 2013/028918 A1 on Feb. 28, 2013, which claims the benefit under Article 8 of the Patent Cooperation Treaty to U.S. Provisional Patent Application Ser. No. 61/526,332, filed Aug. 23, 2011, and titled "WAKEBOARD BINDINGS, WAKEBOARDS INCLUDING SUCH BINDINGS, AND RELATED METHODS."

TECHNICAL FIELD

The disclosure relates generally to wakeboard bindings, wakeboards including such bindings, and methods of making and using such bindings. More specifically, disclosed embodiments relate to wakeboard bindings to which foot restraints (e.g., a boot or slip-on sock binding) may be releasably connected and which enable selective angular repositioning of the foot restraints while they are releasably connected to the wakeboard bindings.

BACKGROUND

A rider of a wakeboard is conventionally connected to the wakeboard by bindings that secure the feet of the rider within a padded underlay supported by an overlay. The overlay conventionally includes straps that wrap behind and in front of the foot to support the ankle of a rider. The straps are also conventionally secured to a base plate that is connected to the wakeboard. To ensure that a rider is not inadvertently ejected from the wakeboard bindings, the overlay is usually secured rather tightly. Thus, significant exertion is usually required to force the rider's feet into the bindings, often requiring uncomfortable contortions, application of lubricant, and significant force, generally while the rider is in the water with the wakeboard. This maneuvering can be especially difficult for new and inexperienced riders. Some bindings include releasable closures for the overlay straps, such as buckles, laces, or ties. While generally enabling a rider to enter the bindings with less exertion, the rider must still perform the fine motor movements required to secure the releasable closures, which may be difficult while in the water and may be particularly difficult in cold water. In addition, riders may inadvertently secure the releasable closures in a way that is looser than intended or recommended, which may cause injury to the rider due to loss of connection with and control of the wakeboard. Conversely, riders may inadvertently secure the releasable closure in a way that is tighter than intended or recommended, which may cause considerable discomfort while riding, even to the point of rendering the ride unsafe. The risk of unintentionally placing the bindings on a rider's feet in a way that is uncomfortable or dangerous may be particularly high in the case of new and inexperienced riders, due to their unfamiliarity with the bindings, inexperience with safe and desirable degrees of tightness, and discomfort in the water.

To accommodate riders that employ differing stances on the wakeboard comfortably, the base plate is conventionally formed of at least two pieces: a first piece that is fixedly secured to the wakeboard and another piece that is adjustably rotatable through various angular positions with respect to the first piece. This angular adjustment is conventionally performed when attaching the bindings to the wakeboard, a process that conventionally involves selecting a desired angular position for the binding and screwing or bolting the first piece to the wakeboard to fixedly secure the other piece in that angular position. Thus, a rider who wishes to adjust the angular positioning of conventional bindings to accommodate a different stance must remove his or her feet from the bindings, remove the bindings from the wakeboard, rotate the pieces of the bindings relative to one another, re-secure the bindings to the wakeboard, replace his or her feet in the bindings, and resume riding.

DISCLOSURE

In some embodiments, wakeboard bindings may comprise a first member configured for connection to a wakeboard. A selective retaining device comprising at least one retaining member biased toward a rotation-precluding position and movable to a rotation-permitting position may be connected to the first member and disposed at a periphery of the first member. A second member may be rotatable with respect to the first member and may comprise at least one engagement member adjacent the selective retaining device. The at least one retaining member may be engaged with the at least one engagement member to preclude rotation of the second member in the rotation-precluding position and the at least one retaining member may be disengaged from the at least one engagement member to permit rotation of the second member in the rotation-permitting position. A releasable step-in connection device comprising a first connection member and a second connection member biased toward a connection position and movable to a release position may be connected to the second member and configured to releasably connect to a foot restraint.

In other embodiments, wakeboard assemblies may comprise a wakeboard and at least one wakeboard binding attached to the wakeboard. The at least one wakeboard binding may comprise a first member connected to the wakeboard. A selective retaining device comprising at least one retaining member biased toward a rotation-precluding position and movable to a rotation-permitting position may be connected to the first member and disposed at a periphery of the first member. A second member may be rotatable with respect to the first member and may comprise at least one engagement member adjacent the selective retaining device. The at least one retaining member may be engaged with the at least one engagement member to preclude rotation of the second member in the rotation-precluding position and the at least one retaining member may be disengaged from the at least one engagement member to permit rotation of the second member in the rotation-permitting position. A releasable step-in connection device comprising a first connection member and a second connection member biased toward a connection position and movable to a release position may be connected to the second member and configured to releasably connect to a foot restraint.

In still other embodiments, methods of positioning a foot restraint on a wakeboard binding may comprise releasably connecting a foot restraint to a releasable step-in connection device and adjusting an angular orientation of the foot restraint while the foot restraint is releasably connected to the releasable step-in connection device. Adjusting the angular orientation of the foot restraint while the foot restraint is releasably connected to the releasable step-in connection device may comprise disengaging at least one retaining member from at least one engagement member located laterally adjacent the foot restraint. The foot restraint may be rotated. The at least one retaining member may be engaged with the at least one engagement member.

BRIEF DESCRIPTION OF THE DRAWINGS

While the disclosure concludes with claims particularly pointing out and distinctly claiming embodiments within the scope of the disclosure, various features and advantages of embodiments encompassed by the disclosure may be more readily ascertained from the following description when read in conjunction with the accompanying drawings, in which:

DETAILED DESCRIPTION

The illustrations presented herein are not meant to be actual views of any particular wakeboard assembly, wakeboard binding, or component thereof, but are merely idealized representations that are employed to describe the disclosed embodiments. Thus, the drawings are not necessarily to scale. Additionally, elements common between figures may retain the same or similar numerical designation.

Directional terms, such as "top," "bottom," "over," "under," "upward," "downward," etc., as used herein, refer to directions relative to the device when it is used during normal operation. Accordingly, such teems are not meant to be limiting, but are merely employed for convenience in describing spatial relationships.

Disclosed embodiments relate generally to wakeboard bindings to which foot restraints (e.g., a boot or slip-on sock binding) may be releasably connected and which enable selective angular repositioning of the foot restraints while they are releasably connected to the wakeboard bindings. More specifically, disclosed are wakeboard bindings that may more easily enable a user to put on and remove foot restraints, to more easily connect the foot restraints to and disconnect the foot restrains from a wakeboard, and to more easily adjust angular orientation of the foot restraints.

Figure 1:
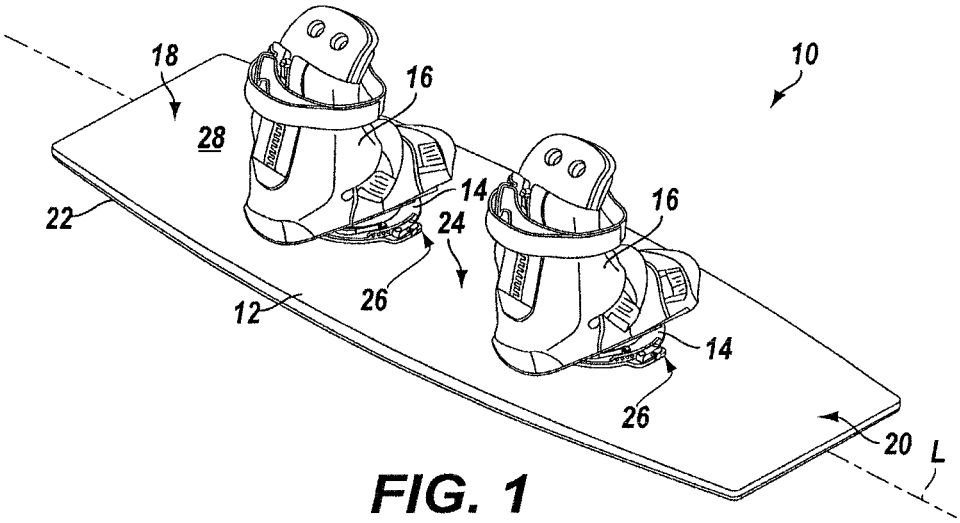
FIG. 1 is a perspective view of a wakeboard assembly including a wakeboard, wakeboard bindings, and foot restraints removably connected to the wakeboard bindings, according to embodiments of the disclosure.

Referring to FIG. 1, a perspective view of a wakeboard assembly 10 including a wakeboard 12, wakeboard bindings 14, and foot restraints 16 removably connected to the wakeboard bindings 14 is shown. The wakeboard 12 comprises a leading end 18 and a trailing end 20 located opposite the leading end 18. The leading end 18 may generally be located in front of the rider with respect to the intended direction of travel, and the trailing end 20 may generally be located behind the rider with respect to the intended direction of travel. The orientation of the leading and trailing ends 18 and 20 may be reversed, however, as some riders may also ride in a "switch" or "fakie" position. The wakeboard 12 may include a plurality of fins (not shown) extending downwardly from a bottom surface 22 of the wakeboard 12. The wakeboard 12 may also exhibit a curved longitudinal profile, with the leading and trailing ends 18 and 20 being curved upward as compared to a central portion 24 of the wakeboard 12, a feature commonly referred to as the "rocker." Binding attachment hardware 26 conventionally comprise threaded inserts embedded into the top surface 28 of the wakeboard 12, the tops of the binding attachment hardware 26 generally being flush with the top surface 28. In conventional practice, the binding attachment hardware 26 is disposed in a standard pattern, enabling a variety of different bindings to be attached to the wakeboard 12, and redundant binding attachment hardware 26 may be provided, enabling bindings to be located at different positions along a longitudinal axis L extending from the trailing end 20 to the leading end 18 in the intended direction of travel. The wakeboard 12 may comprise a buoyant material (i.e., a material that floats in water) and may specifically comprise a lightweight core (e.g., a foam or wood core) located within a relatively stronger and stiffer shell (e.g., a fiberglass or carbon fiber shell).

Figure 2:
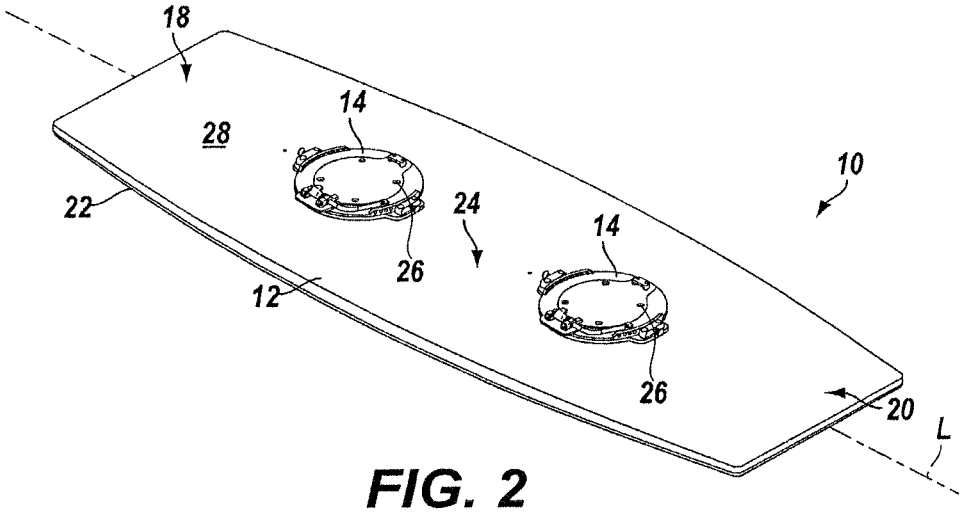
FIG. 2 is a perspective view of the wakeboard assembly of FIG. 1 with the foot restraints removed, according to embodiments of the disclosure.

Referring to FIG. 2, a perspective view of the wakeboard assembly 10 of FIG. 1 with the foot restraints 16 removed is shown. The wakeboard bindings 14 are attached to the wakeboard 12. Specifically, the wakeboard bindings 14 are attached to the wakeboard 12 using binding attachment hardware 26, which may comprise screws or bolts that are inserted through holes in the wakeboard bindings 14 and are threadedly engaged with the threaded inserts discussed previously. Returning to FIG. 1, the foot restraints 16 are removably attached to the wakeboard bindings 14. The foot restraints 16 are configured to contain the feet of a rider such that the rider may effectively control operation of the wakeboard assembly 10. The foot restraints 16 are also configured to be removed from the wakeboard bindings 14, enabling a rider to place the foot restraints 16 on his or her feet away from the wakeboard 12 and wakeboard bindings 14 and to more easily and quickly attach to and detach from the wakeboard bindings 14. In addition, the wakeboard bindings 14 are configured to selectively adjust the angular position of the foot restraints 16 without removing the wakeboard bindings 14 from the wakeboard 12 and even while foot restraints 16 are removably attached to the wakeboard bindings 14, with or without a rider's feet secured within the foot restraints 16.

Figure 3:
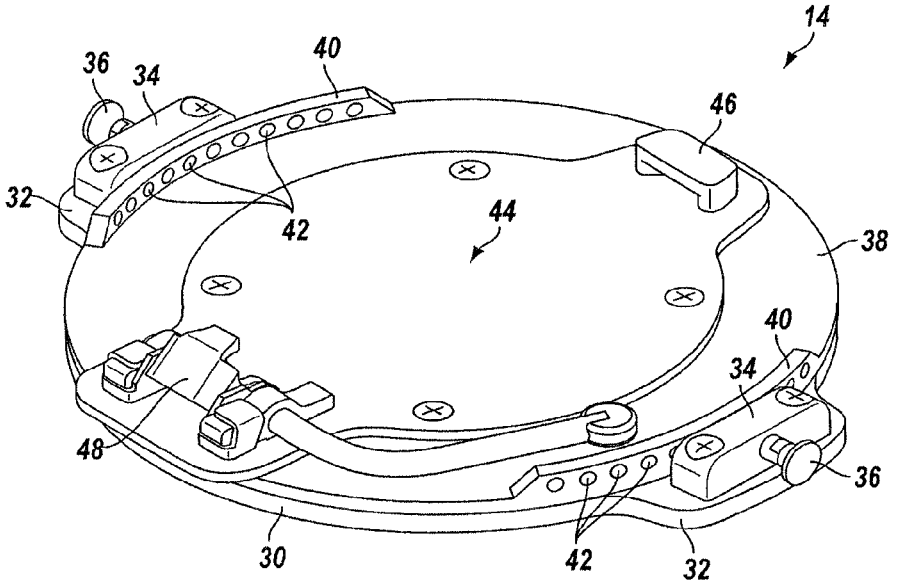
FIG. 3 is a perspective view of one of the wakeboard bindings of FIG. 1, according to an embodiment of the disclosure.

Referring to FIG. 3, a perspective view of one of the wakeboard bindings 14 of FIG. 1 is shown. The wakeboard binding 14 may include a first member 30 configured for connection to a wakeboard 12 (see FIGS. 1 and 2). The first member 30 may comprise, for example, a base plate including holes (not shown) therethrough. More specifically, the first member 30 may comprise a generally circular sheet of material (e.g., a generally disc-shaped member). The holes (not shown) may be sized and positioned to enable binding attachment hardware 26 (e.g., screws or bolts and corresponding threaded inserts as in FIGS. 1 and 2) to attach the first member 30 to the wakeboard 12 (see FIGS. 1 and 2). For example, the holes (not shown) may be located in radially extending tabs 32 located at opposing ends of a periphery of the first member 30. In addition, the holes (not shown) may conform to a standard placement for binding attachment hardware 26 (see FIGS. 1 and 2), which may enable the wakeboard bindings 14 to be used with any conventional wakeboard 12 (see FIGS. 1 and 2). Thus, the first member 30 may be fixedly attached to the wakeboard 12 (see FIGS. 1 and 2) in such a way that it is not intended to be removed from the wakeboard 12 (see FIGS. 1 and 2) during normal use (i.e., while a rider is in the water with the wakeboard 12 during or between rides).

The wakeboard binding 14 may further comprise at least one selective retaining device 34 connected to the first member 30. Selective retaining devices 34 may be disposed, for example, at opposing ends of the periphery of the first member 30. For example, the selective retaining devices 34 may extend upwardly from the radially extending tabs 32 located at the periphery of the first member 30. Thus, the selective retaining devices 34 may be located above the first member 30. The selective retaining devices 34 may comprise at least one retaining member 36 biased toward a rotation-precluding position and movable to a rotation-permitting position. Retaining members 36 may comprise pins configured for insertion into corresponding holes in another device or structure in some embodiments. In other embodiments, retaining members 36 may comprise, for example, interlocking teeth configured to engage interlocking teeth in the other device or structure, friction pads configured to abut against the other device or structure, members having holes therein into which protrusions from the other device or structure may extend, or other members that interact with the other device or structure to preclude relative rotation in one position and permit relative rotation in another position. At least a portion of the selective retaining devices 34 may be formed integrally with the first member 30 in some embodiments. In other embodiments, the selective retaining devices 34 may comprise separately formed structures that are attached to the first member 30.

The wakeboard binding 14 may also comprise a second member 38 rotatable with respect to the first member 30. For example, the second member 38 may comprise a generally circular sheet of material (e.g., a generally disc-shaped member) that may be selectively rotated with respect to the first member 30. The second member 38 may comprise at least one engagement member 40 radially adjacent the selective retaining device 34. Engagement members 40 may be located at opposing ends (e.g., on opposing sides) of a periphery of the second member 38. The engagement members 40 may comprise, for example, upwardly extending members that extend at least partially around a circumference of the second member 38. The engagement members 40 may comprise a single, integrally formed unit with the second member 38 in some embodiments. In other embodiments, the engagement members 40 may comprise separate units that are attached to the second member 38. Retaining holes 42 may be formed in the engagement members 40 in some embodiments. For example, retaining holes 42 may be formed incrementally at differing angular positions along the circumferentially extending engagement members 40. In other embodiments, the engagement members 40 may include interlocking teeth, friction surfaces, radially extending protrusions, or other members that may interact with the retaining members 36 to selectively preclude and permit rotation of the second member 38 with respect to the first member 30. Thus, the retaining members 36 may be engaged with (e.g., inserted into or received within) the engagement members 40 to preclude rotation of the second member 38 in the rotation-precluding position. Further, the retaining members 36 may be disengaged from (e.g., withdrawn from within or retracted from over) the engagement members 40 to permit rotation of the second member 38 in the rotation-permitting position. In this way, the angular orientation of the second member 38 and, therefore, of the foot restraint 16, may be modified without disconnecting the wakeboard binding 14 from the wakeboard 12 (see FIGS. 1 and 2).

The wakeboard binding 14 may comprise a releasable step-in connection device 44 configured to releasably connect to a foot restraint 16 (see FIG. 1) during normal operation of the wakeboard binding 14 in some embodiments. In other embodiments, the foot restraint 16 (see FIGS. 1 and 2) may be permanently connected to (e.g., integrally formed with) a portion of the wakeboard binding 14 (e.g., permanently connected to the second member 38) or may be attached to the portion of the wakeboard binding 14 (e.g., attached to the second member 38) in a way that is not intended to be released during normal operation of the wakeboard binding 14. The releasable step-in connection device 44 may be connected to the second member 38 in such a way as to transmit rotation of the second member 38 to a foot restraint 16 (see FIGS. 1 and 2), which may be releasably connected to the releasable step-in connection device 44. The releasable step-in connection device 44 may comprise a generally circular plate (e.g., a generally disc-shaped member) disposed on and attached to the second member 38 in some embodiments. The releasable step-in connection device 44 may be generally centrally located on the wakeboard binding 14, and thus may be flanked by the selective retaining devices 34.

The releasable step-in connection device 44 may comprise at least two points of attachment to which the foot restraint 16 (see FIGS. 1 and 2) may be attached. For example, the releasable step-in connection device 44 may comprise a first connection member 46 and a second connection member 48 biased toward a connection position and movable to a release position. The first connection member 46 may comprise a ledge defining a space between the ledge and a surface beneath the ledge (e.g., the generally circular plate or the second member 38) under which a protrusion attached to a foot restraint 16 (see FIGS. 1 and 2) may be inserted in some embodiments. In other embodiments, the first connection member 46 may comprise a protrusion, which may be inserted under a ledge attached to the foot restraint 16 (see FIGS. 1 and 2). The second connection member 48 may comprise a latch configured to engage with and longitudinally secure a surface defining a recess at a heel portion of a foot restraint 16 (see FIGS. 1 and 2) in a connection position and to disengage from the recess at the heel portion of the foot restraint in a release position in some embodiments. The second connection member 48 may be biased toward the connection position. For example, a spring may rotationally bias the latch of the second connection member 48 toward the connection position. In other embodiments, the second connection member 48 may comprise, for example, a spring-loaded pin. The second connection member 48 may be movable from the connection position to the release position by a rider using, for example, a lever connected to the latch of the second connection member 48.

Figure 4:
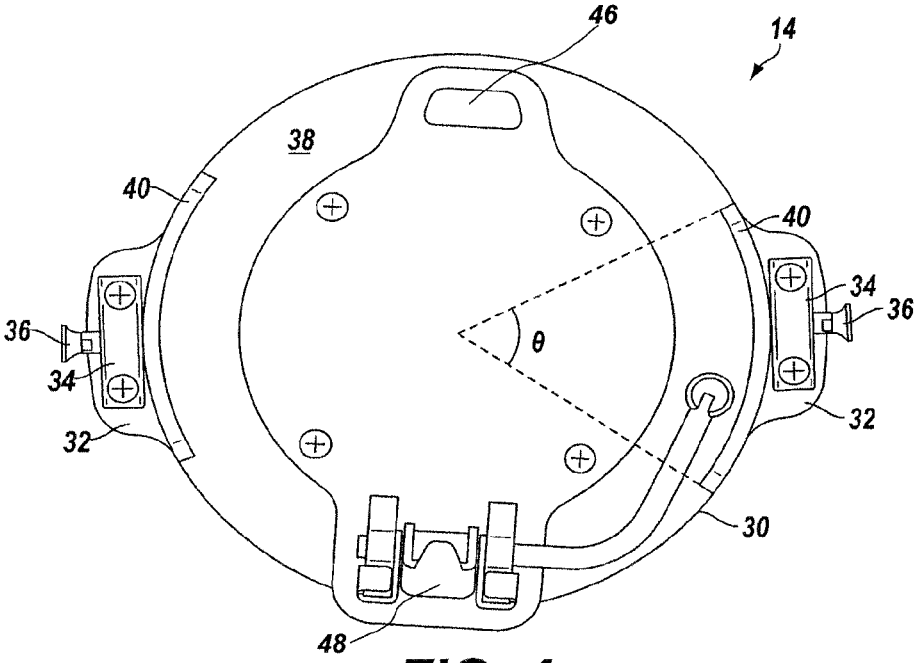
FIG. 4 is a plan view of the wakeboard binding of FIG. 3.

Referring to FIG. 4, a plan view of the wakeboard binding 14 of FIG. 3 is shown. The engagement members 40 may extend only partially around the circumference of the second member 38. Thus, the degree to which the second member 38 may rotate may be limited by the extent to which the second member 38 extends around the circumference of the second member 38. For example, the degree to which the second member 38 may rotate may comprise an included rotation angle θ. The included rotation angle θ may be about 60°. For example, the included rotation angle θ may be between about 75° and about 45°. More specifically, the included rotation angle θ may be between about 68° and about 53°. Thus, the second member 38 may be rotatable with respect to the first member 30 over a range of about 60°. In this way, a rider may alter his or her stance (i.e., alter the angular orientation of the second member 38 and, therefore, of the foot restraint 16) over a range of about 60°.

Figure 5:
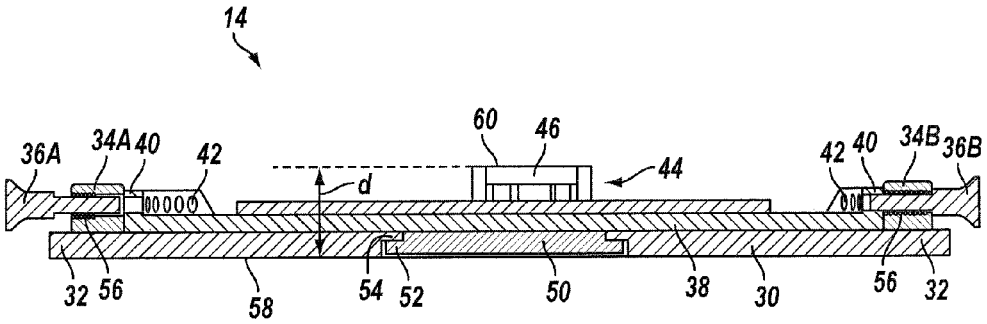
FIG. 5 is a cross-sectional view of the wakeboard binding of FIG. 3.

Referring to FIG. 5, a cross-sectional view of the wakeboard binding 14 of FIG. 3 is shown. A longitudinal securing member 50 may be used to preclude longitudinal separation of the second member 38 from the first member 30. The longitudinal securing member 50 may be connected to the second member 38, and may rotate with the second member 38 relative to the first member 30. For example, the longitudinal securing member 50 may be screwed, bolted, riveted, welded, adhered, or otherwise attached to the second member 38 in such a way that rotation of the second member 38 is transmitted to the longitudinal securing member 50. Mechanical interference between the longitudinal securing member 50 and the first member 30 may preclude longitudinal separation of the second member 38 from the first member 30. For example, the longitudinal securing member 50 may comprise a disc having a lower annular extension 52 at a lower portion thereof. The longitudinal securing member 50 may be connected to the second member 38 through a hole formed in the first member 30. An upper annular extension 54 may extend from the first member over the lower annular extension 52 of the longitudinal securing member 50. Abutting surfaces of the lower and upper annular extensions 52 and 54 may preclude longitudinal separation of the second member 38 from the first member 30.

The wakeboard binding 14 may include a first selective retaining device 34A having a first retaining member 36A and a second selective retaining device 34B having a second retaining member 36B. The second selective retaining device 34B is shown in the rotation-precluding position. In the rotation-precluding position, the second retaining member 36B extends radially inwardly from the second selective retaining device 34B, which is disposed on a radially extending tab 32 at the periphery of the first member 30, and is inserted into a retaining hole 42 of the adjacent engagement member 40. Thus, mechanical interference between the engagement member 40 and the second retaining member 36B prevents the second member 38 from rotating relative to the first member 30 in the rotation-precluding position. The first and second retaining members 36A and 36B are biased toward the rotation-precluding position. For example, a biasing member 56 may push the first and second retaining members 36A and 36B toward the rotation-precluding position. The biasing member 56 may comprise, for example, a spring, a pneumatic piston, a compressible polymer or other elastomer, or another member that may exert a force to bias the first and second retaining members 36A and 36B toward the rotation-precluding position. The first selective retaining device 34A is shown in the rotation-permitting position. In the rotation-permitting position, the first retaining member 36A is withdrawn into the first selective retaining device 34A, which is disposed on a radially extending tab 32 at the periphery of the first member 30, and is retracted from a retaining hole 42 of the adjacent engagement member 40. Once the first retaining member 36A is removed from within the retaining hole 42, the second member 38 is free to rotate relative to the first member 30 in the rotation-permitting position.

A rider wishing to adjust the angular positioning of the second member 38 relative to the first member 30 and, therefore, the angular positioning of a foot restraint 16 (see FIGS. 1 and 2) that may be releasably connected to the second member 38 using, for example, a releasable step-in connection device 44, may pull on the first and second retaining members 36A and 36B, compressing the biasing members 56 and withdrawing the first and second retaining members 36A and 36B from within the retaining holes 42. In other words, the rider may move the first and second retaining members 36A and 36B from the rotation-precluding position into the rotation-permitting position. The rider may then rotate the second member 38 relative to the first member 30 by, for example, twisting a foot located within a foot restraint 16 (see FIGS. 1 and 2) that is releasably attached to the releasable step-in connection device 44. Once the first and second retaining members 36A and 36B are aligned with other retaining holes 42 in the engagement members 40, the rider may release the first and second retaining members 36A and 36B, and the biasing members 56 may cause the first and second retaining members 36A and 36B to insert themselves into the other retaining holes 42 with which the first and second retaining members 36A and 36B are aligned. In other words, the first and second retaining members 36A and 36B may automatically return to the rotation-precluding position after being released by the rider. Thus, the first and second selective retaining devices 34A and 34B may default to the rotation-precluding position, which may act as a fail-safe for the wakeboard binding 14.

A distance d between a bottom surface 58 of the wakeboard binding 14 and an uppermost portion 60 of the wake board binding 14 may be about 1 inch (2.54 cm). For example, the distance d between the bottom surface 58 of the first member 30 and the uppermost portion 60 of the first connection member 46 of the releasable step-in connection device 44 may be about 1 inch (2.54 cm). More specifically, the distance d between the bottom surface 58 of the first member 30 and the uppermost portion 60 of the first connection member 46 of the releasable step-in connection device 44 may be between about 0.75 inch (1.91 cm) and about 2 inches (5.08 cm). Thus, the wakeboard binding 14 may have a lower vertical height above the wakeboard 12 (see FIGS. 1 and 2) than other, prior wakeboard bindings.

Figure 6:
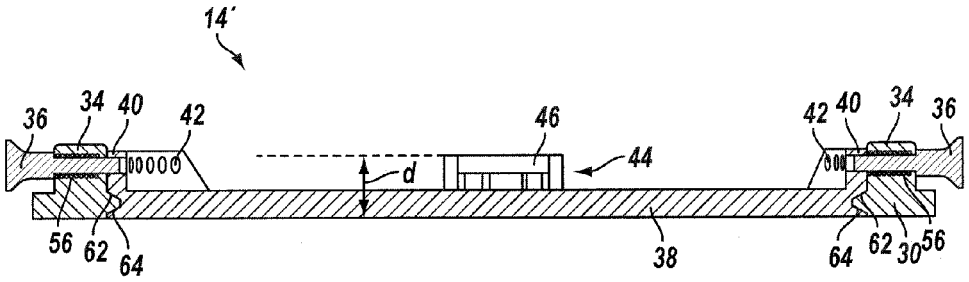
FIG. 6 is a cross-sectional view of another embodiment of a wakeboard binding, according to the disclosure.

Referring to FIG. 6, a cross-sectional view of another embodiment of a wakeboard binding 14' is shown. In some embodiments, at least a portion of the second member 38 may be located in the same horizontal plane as at least a portion of the first member 30. For example, the first member 30 may comprise a generally annularly shaped portion positioned concentrically around and in the same horizontal plane as a generally disc-shaped portion of the second member 38. Mechanical interference between the first member 30 and the second member 38 may preclude longitudinal separation of the first member 30 from the second member 38. The first member 30 may comprise at least one radially extending protrusion 62 (e.g., an annular protrusion or a series of tooth-like protrusions) extending radially inwardly toward the generally disc-shaped portion of the second member 38. The second member 38 may comprise an annular groove 64 around an outer circumference of the generally disc-shaped portion thereof in which the radially extending protrusion 62 is disposed. Mechanical interference between the radially extending protrusion 62 and surface of the annular groove 64 may preclude longitudinal separation of the second member 38 from the first member 30.

In some embodiments, the first connection member 46 and the second connection member 48 (see FIGS. 3 and 4) of the releasable step-in connection device 44 may be connected directly to and extend directly upwardly from the second member 38. Thus, there may be no intermediate generally circular plate interposed between the first and second connection members 46 and 48 (see FIGS. 3 and 4) and the second member 38. In such embodiments, the first and second connection members 46 and 48 (see FIGS. 3 and 4) may be separately formed and subsequently attached to or integrally formed with the second member 38.

The wakeboard binding 14 may be formed from materials generally suitable for prolonged exposure to the water and for retaining structural integrity against forces generally encountered during wakeboarding. For example, the wakeboard binding 14 may comprise a metal or metal alloy (e.g., stainless steel or aluminum) or a polymer (e.g., a thermoplastic). Different components of the wakeboard bindings 14 may be formed from different materials in some embodiments. For example, the first and second members 30 and 38 may be at least substantially composed of (i.e., entirely composed of with the exception of naturally occurring contaminants) a thermoplastic, while the retaining members 36 and the biasing members 56 may be at least substantially composed of aluminum. In other embodiments, each component of the wakeboard bindings 14 may be formed from the same material. The wakeboard bindings 14 may be formed using processes generally known in the art, such as, for example, injection molding and machining.

Figure 7:
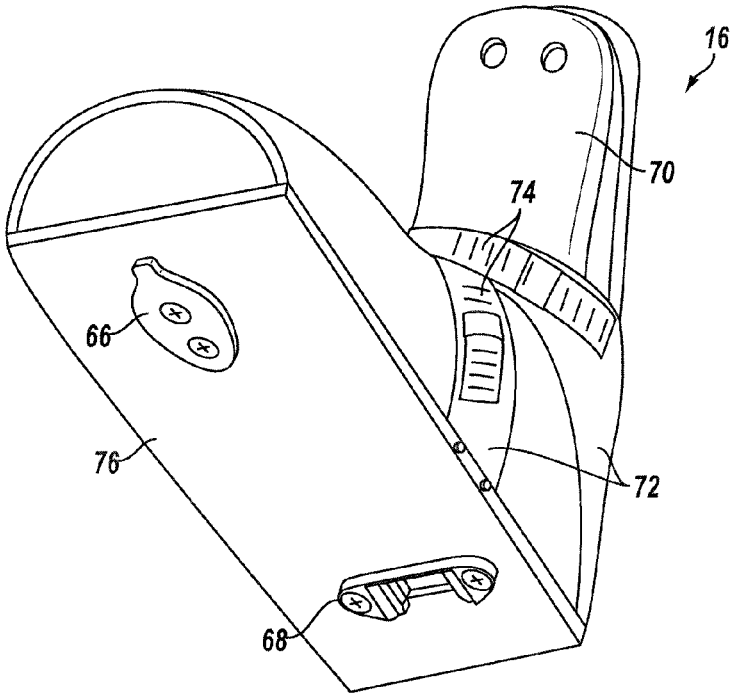
FIG. 7 is a perspective view of one of the foot restraints shown in FIG. 1.

Referring to FIG. 7, a perspective view of one of the foot restraints 16 of FIG. 1 is shown. The foot restraint 16 is configured to releasably connect to a releasable step-in connection device 44 (see FIGS. 3, 5, and 6) using at least two points of attachment. For example, a first mating member 66 configured to be secured by the first connection member 46 of a releasable step-in connection device 44 (see FIGS. 3, 5, and 6) may be disposed proximate a toe portion of the foot restraint 16. The first mating member 66 may comprise a protrusion which may be inserted underneath and longitudinally secured by a ledge of the first connection member 46 of a releasable step-in connection device 44 (see FIGS. 3, 5, and 6) in some embodiments. In other embodiments, the first mating member 66 may comprise a ledge, under which a protrusion of a first connection member 46 of a releasable step-in connection device 44 may be inserted. A second mating member 68 may comprise a recess including a surface at a heel portion of the foot restraint 16 with which a latch of a second connection member 48 (see FIG. 3) may be configured to engage and longitudinally secure in a connection position and from which a latch of a second connection member 48 (see FIGS. 2 through 4) may be configured to disengage in a release position in some embodiments. In other embodiments, the second connection member 48 (see FIGS. 2 through 4) may comprise, for example, a hole into which a spring-loaded pin of a second connection member 48 (see FIGS. 2 through 4) may extend.

In some embodiments, the foot restraint 16 may further comprise a padded underlay 70 supported by an overlay 72. The overlay 72 may include adjustable straps 74 that wrap behind and in front of the foot to support the ankle of a rider. The adjustable straps 74 may be adjusted in length to accommodate riders having feet of differing sizes using, for example, latches, buckles, hook-and-loop fasteners, or laces. The adjustable straps 74 may also be secured to a base plate 76 to which the first and second mating members 66 and 68 are connected (e.g., by being separately formed and subsequently connected or by being integrally formed together) and from which the first and second mating members 66 and 68 downwardly extend. Thus, the foot restraint 16 may comprise a conventional wakeboard binding to which the first and second mating members 66 and 68 have been attached. In this way, existing wakeboard assemblies 10 (see FIGS. 1 and 2) may be retrofitted by attaching the wakeboard bindings 14, 14' (see FIGS. 1 through 6) discussed previously to the wakeboard 12 (see FIGS. 1 and 2) and by attaching the first and second mating members 66 and 68 to the wakeboard bindings previously attached to the wakeboard 12 (see FIGS. 1 and 2) to form the foot restraint 16.

Figure 8:
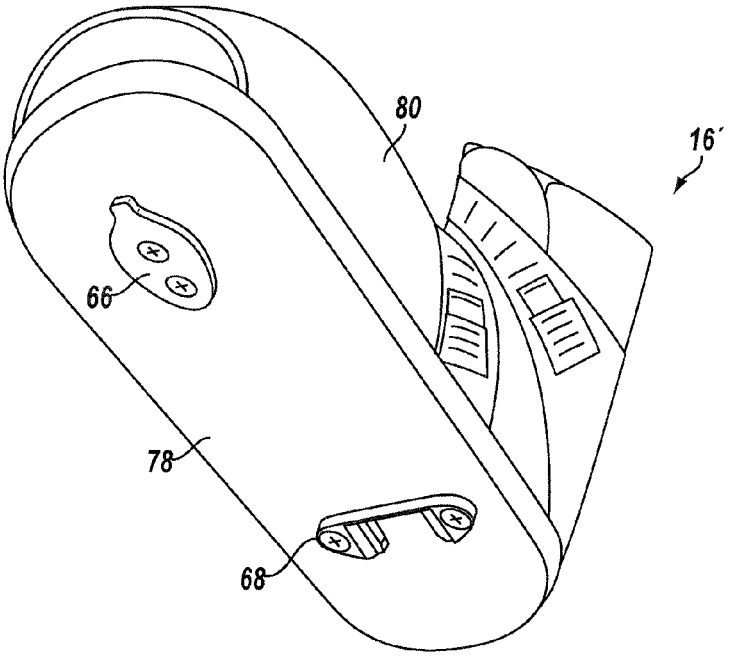
FIG. 8 is a perspective view of another embodiment of a foot restraint that may be used in connection with the wakeboard bindings of FIGS. 3 through 6.

FIG. 8 depicts a perspective view of another embodiment of a foot restraint 16' that may be used in connection with the wakeboard bindings 14, 14' of FIGS. 1 through 6. The foot restraint 16' generally comprises the first and second mating members 66 and 68 as discussed previously in connection with FIG. 7. The first and second mating members 66 and 68 may be connected to a sole 78 (e.g., by being separately formed and subsequently connected or by being integrally formed together) and extend downwardly from the sole 78. A boot upper 80 may extend upwardly from the sole 78 and be configured to contain a foot of a rider. The boot upper 80 may include drainage portions that may enable water that would otherwise be trapped within an enclosed boot structure to drain from the boot upper 80. Adjustable straps 74 that may be adjusted in length to securely retain the foot of a rider may be adjusted using, for example, latches, buckles, hook-and-loop fasteners, or laces. Thus, the foot restraint 16' may comprise a boot configured for use with a wakeboard 12 (see FIGS. 1 and 2) that may accommodate a smaller range of sizes of feet and may provide a custom fit for a given rider.

Figure 9:
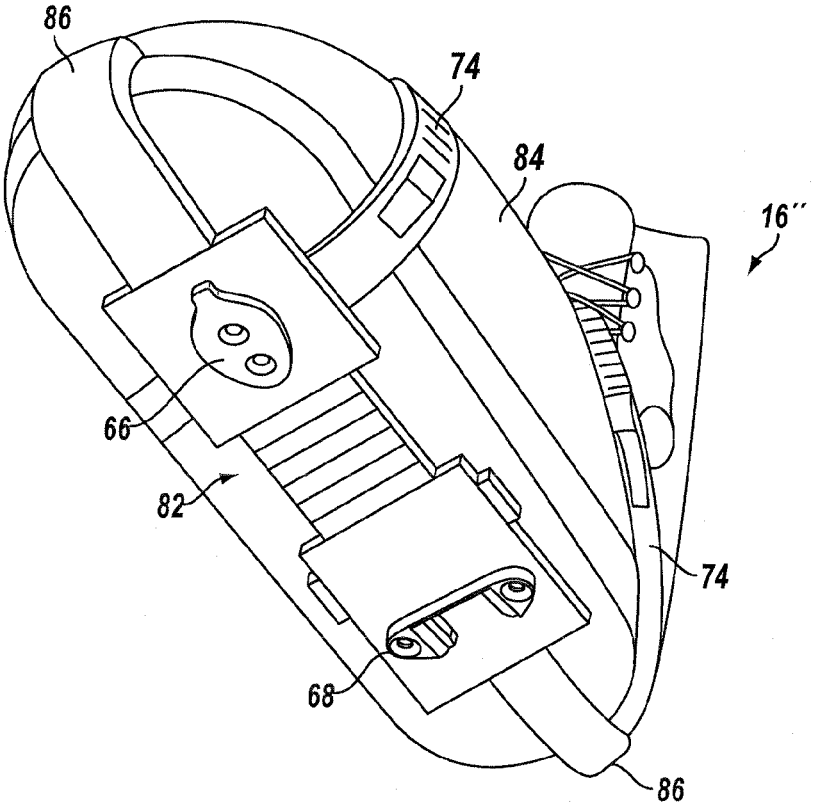
FIG. 9 is a perspective view of yet another embodiment of a foot restraint that may be used in connection with the wakeboard bindings of FIGS. 3 through 6.

FIG. 9 illustrates a perspective view of yet another alternative embodiment of a foot restraint 16" that may be used in connection with the wakeboard bindings 14, 14' of FIGS. 1 through 6. The foot restraint 16" generally comprises the first and second mating members 66 and 68 as discussed previously in connection with FIG. 7. The first and second mating members 66 and 68 may be connected to a skeleton structure 82 that may be attached to conventional footwear 84, such as, for example, a sneaker, water sock, or hiking boot. The skeleton structure 82 may include, for example, adjustable straps 74 for longitudinally securing the conventional footwear 84 to the skeleton structure 82, may include upwardly extending stops 86 that may secure the conventional footwear 84 in a heel-toe direction, and may be adjustable in length to accommodate conventional footwear 84 of different sizes. In this way, the skeleton structure 82 may enable riders to foot the foot restraint 16" using their own conventional footwear 84 with which they are comfortable and may enable riders with vastly differently sized feet to use the same wakeboard bindings 14, 14' (see FIGS. 1 through 6).

Figure 10:
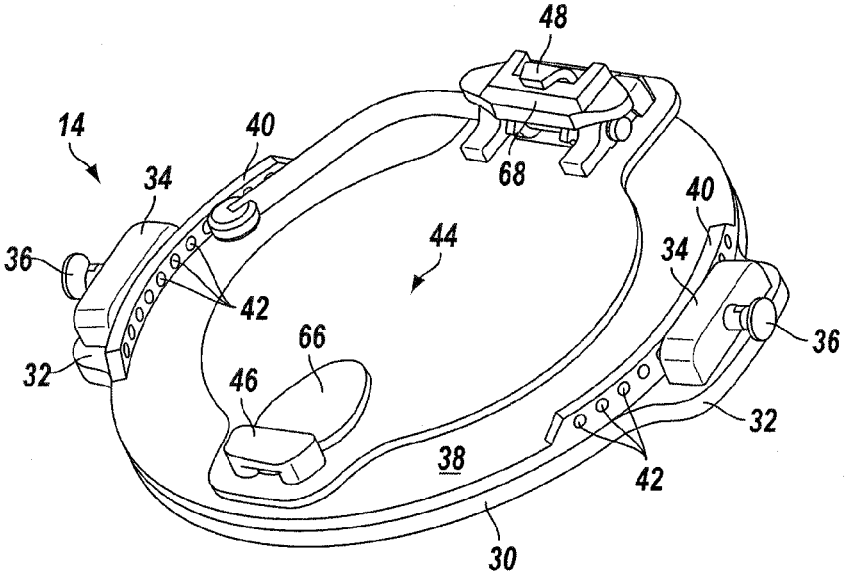
FIG. 10 is a perspective view of the wakeboard binding of FIG. 3 engaged with connection portions of the foot restraints shown in FIGS. 7 through 9.

FIG. 10 is a perspective view of the wakeboard binding 14 of FIGS. 1 through 5 engaged with first and second mating members 66 and 68 of the foot restraints 16 shown in FIGS. 7 through 9. A rider may position the foot restraint 16, 16', 16" (see FIGS. 7 through 9) on the wakeboard binding 14. The rider may releasably connect the foot restraint 16, 16', 16" (see FIGS. 7 through 9) to the releasable step-in connection device 44. More specifically, the rider may engage the first mating member 66 at the toe portion of the foot restraint 16, 16', 16" (see FIGS. 7 through 9) with the first connection member 46 of the releasable step-in connection device 44. For example, the rider may insert a protrusion extending in a heel-to-toe direction of the first mating member 66 located on a bottom surface (e.g., on the base plate 76, on the sole 78, or on the skeleton structure 82) of the foot restraint 16, 16', 16" (see FIGS. 7 through 9) under a ledge of the first connection member 46 to longitudinally secure the toe portion of the foot restraint 16, 16', 16" (see FIGS. 7 through 9) to the releasable step-in connection device 44.

The rider may lower a heel portion of the foot restraint 16, 16', 16" (see FIGS. 7 through 9) toward the releasable step-in connection device 44. As the heel portion of the foot restraint 16, 16', 16" (see FIGS. 7 through 9) is lowered toward the releasable step-in connection device 44, complementary surfaces of the second connection member 48 and the second mating member 68 may cause the second connection member 48 to move from the connection position to the release position. For example, a sloped surface on the second mating member 68 may engage a sloped surface on the latch of the second connection member 48, causing the latch to rotate from the connection position to the release position. As the heel portion of the foot restraint 16, 16', 16" (see FIGS. 7 through 9) is lowered farther toward the releasable step-in connection device 44, the second mating member 68 may engage with the second connection member 48 due to the bias of the second connection member 48 toward the connection position. For example, the latch of the second connection member 48 may extend upwardly into a recess defined by the second mating member 68, and the bias of the second connection member 48 may cause it to rotate into the connection position and engage with a surface defining the recess.

Should the rider wish to remove the foot restraint 16, 16', 16" (see FIGS. 7 through 9) from the releasable step-in connection device 44, the rider may move the second connection member 48 from the connection position to the release position and detach the foot restraint 16, 16', 16" (see FIGS. 7 through 9) from the releasable step-in connection device 44. For example, the rider may rotate a lever connected to the latch of the second connection member 48, causing the second connection member 48 to rotate and disengage from the surface of the recess of the second mating member 68. The rider may then raise the heel portion of the foot restraint 16, 16', 16"0 (see FIGS. 7 through 9) and withdraw the protrusion of the first mating member 66 from under the ledge of the first connection member 46. In this way, riders, and particularly new and inexperienced riders, may perform whatever difficult, laborious, or awkward maneuvering may be required to secure the riders' feet within the foot restraints 16, 16', 16" (see FIGS. 7 through 9) while out of the water, and may more easily attach and detach the foot restraints 16, 16', 16" (see FIGS. 7 through 9) from the wakeboard bindings 14.

In further positioning the foot restraint 16, 16', 16" (see FIGS. 7 through 9) on the wakeboard binding 14, a rider may adjust an angular orientation of the foot restraint 16, 16', 16" (see FIGS. 7 through 9) while the foot restraint 16, 16', 16" (see FIGS. 7 through 9) is releasably connected to the releasable step-in connection device 44. For example, the rider may disengage the retaining members 36 of the selective retaining device 34 from the engagement members 40 located laterally adjacent (e.g., flanking) the foot restraint 16, 16', 16" (see FIGS. 7 through 9). More specifically, the rider may pull radially outwardly on the retaining members 36, causing the biasing members 56 (see FIGS. 5 and 6) to compress and causing the pins of the retaining members 36 to withdraw from within the retaining holes 42 of the engagement members 40. Thus, the retaining members 36 may be moved from the rotation-precluding position to the rotation-permitting position. The rider may then rotate the foot restraint 16, 16', 16" (see FIGS. 7 through 9) to another, different angular position, which may cause the second member 38 to which the foot restraint 16, 16', 16" (see FIGS. 7 through 9) is connected to rotate correspondingly relative to the first member 30. The rider may then engage the retaining members 36 with the engagement members 40 by releasing the retaining members 36 and allowing the biasing members 56 (see FIGS. 5 and 6) to return the retaining members 36 to the rotation-precluding position. Thus, a rider may more easily adjust his or her stance without disconnecting the wakeboard bindings 14 from the wakeboard 12 (see FIGS. 1 and 2) and even without removing his or her feet from the foot restraints 16 (see FIG. 1).

Figure 11:
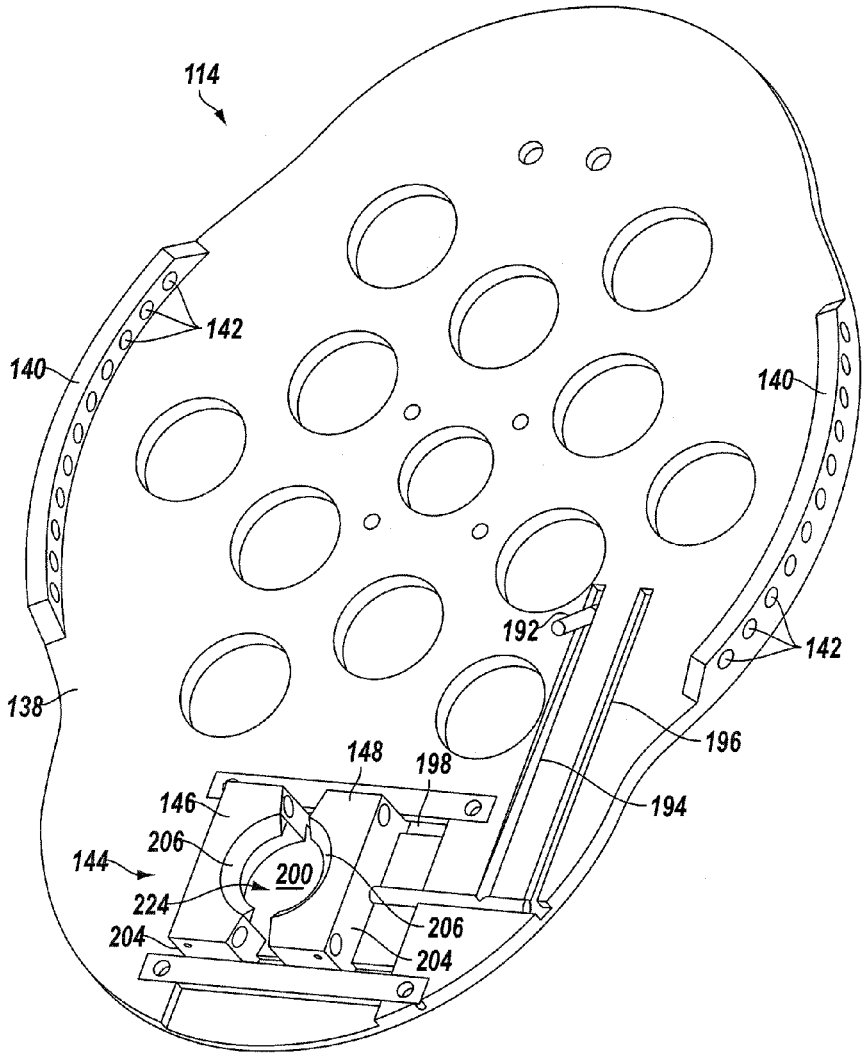
FIG. 11 is a perspective view of another embodiment of a wakeboard binding.

Referring to FIG. 11, a perspective view of another embodiment of a wakeboard binding 114 is shown. For the sake of simplicity, a first member of the wakeboard binding 114 to which a second member 138 may be rotatably connected is not shown, though such a first member may be at least substantially similar to that described in connection with FIGS. 3 through 6. The wakeboard binding 114 may include a releasable step-in connection device 144. The releasable step-in connection device 144 may comprise a first connection member 146 and a second connection member 148 configured to cooperatively retain a foot restraint 116 (see FIG. 13) secured to the second member 138 of the wakeboard binding 114. The releasable step-in connection device 144 may define a single location of attachment for the foot restraint 116 (see FIG. 13) to the wakeboard binding 114 in some embodiments. In other embodiments, the releasable step-in connection device 144 may comprise another connection member, similar to the first connection member 46 described previously in connection with FIGS. 3, 5, 6, and 10, to define another location of attachment for the foot restraint 116. The releasable step-in connection device 144 may be movable between a release state (not shown) and a connection state, as shown in FIG. 11. In a connection position of the first and second connection members 146 and 148 (corresponding to the connection state of the releasable step-in connection device 144), the first and second connection members 146 and 148 may be relatively near one another to constrain movement of at least one mating member (e.g., a unitary mating member 190 (see FIGS. 13 and 14)) and impede (e.g., prevent) separation of a foot restraint 116 (see FIG. 13) from the wakeboard binding 114. When the first and second connection members 146 and 148 are in a release position (corresponding to the release state of the releasable step-in connection device 144), the first and second connection members 146 and 148 may be relatively distanced from one another to permit movement of at least one mating member and enable separation of a foot restraint 116 (see FIG. 13) from the wakeboard binding 114.

At least one of the first and second connection members 146 and 148 may be movable with respect to the other of the first and second connection members 146 and 148 to assume the connection and release positions. For example, the second connection member 148 may be movable, and the first connection member 146 may be fixed. To move the second connection member 148 from the connection position to the release position, a user may grasp a release member 192 connected to the second connection member 148 and exert a force on the release member 192 directed away from the first connection member 146 from the perspective of the second connection member 148. For example, a user may grasp a release member 192 comprising a lever and pull it laterally away from the first connection member 146 to move the second connection member 148 (e.g., along a track 198 with which the second connection member 148 is engaged and by which the second connection member 148 is connected to the second member 138) into the release position. The second connection member 148 may be biased toward the connection position, for example, by a spring. Accordingly, the second connection member 148 may return to the connection position by freeing the release member 192 and allowing the second connection member 148 to return to the connection position. In other embodiments, the first connection member 146 may be movable and the second connection member 148 may be fixed, or the first and second connection members 146 and 148 may both be movable to assume the release and connection positions. In some embodiments, movement of the first connection member 146, the second connection member 148, or both may be in directions other than lateral, such as, for example, front to back, back to front, or diagonal.

In some embodiments, the first and second connection members 146 and 148 may be releasably locked into the connection and release positions. For example, the release member 192 may be disposed in a connection groove 194 to impede (e.g., prevent) the second connection member 148 from unintentionally moving from the connection position to the release position. The release member 192 may be disposed in a release groove 196 to impede (e.g., prevent) the second connection member 148 from unintentionally moving from the release position to the connection position. For example, the release member 192 may be biased toward the connection and release grooves 194 and 196 (e.g., by a spring) such that freeing the release member 192 from the user's grasp causes the release member 192 to enter a respective groove 194 or 196 with which it is aligned. Such a configuration may enable a user to more easily ensure that the foot restraint 116 (see FIG. 13) does not become detached from the wakeboard binding 114 when the user desires to remain connected to the wakeboard binding 114 (e.g., while wakeboarding) and to impede (e.g., prevent) the second connection member 148 from returning to the connection position before the user has detached the foot restraint 116 (see FIG. 13) from the wakeboard binding 114.

Figure 12:
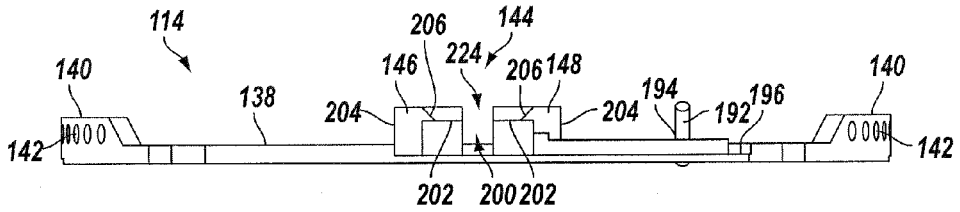
FIG. 12 is a cross-sectional end view of the wakeboard binding of FIG. 11.

Referring to FIG. 12, a cross-sectional end view of the wakeboard binding 114 of FIG. 11 is shown. The first and second connection members 146 and 148 may cooperatively define a retaining cavity 200 in which at least a portion of at least one mating member (e.g., a unitary mating member 190 (see FIGS. 13 and 14)) may be disposed when a foot restraint 116 (see FIG. 13) is attached to the wakeboard binding 114. For example, each of the first and second connection members 146 and 148 may comprise an overhanging ledge 202 with which a mating member 190 (see FIGS. 13 and 14) may engage and which may limit (e.g., prevent) separation movement between a foot restraint 116 (see FIG. 13) and the wakeboard binding 114. An opening 224 of the retaining cavity 200, through which a mating member 190 (see FIGS. 13 and 14) may extend, may define a generally circular shape in some embodiments. Each overhanging ledge 202 may comprise a sloped surface 206, which may enable movement of the first and second connection members 146 and 148 to the release position during insertion of a mating member 190 (see FIGS. 13 and 14) into the retaining cavity 200 and may enable easier alignment of the mating member 190 (see FIGS. 13 and 14) with the retaining cavity 200. Each of the first and second connection members 146 and 148 may further comprise at least one sidewall 204 with which a mating member 190 (see FIGS. 13 and 14) or a foot restraint 116 (see FIG. 13) may engage and which may limit (e.g., prevent) rotational movement between the foot restraint 116 (see FIG. 13) and the wakeboard binding 114.

Figure 13:
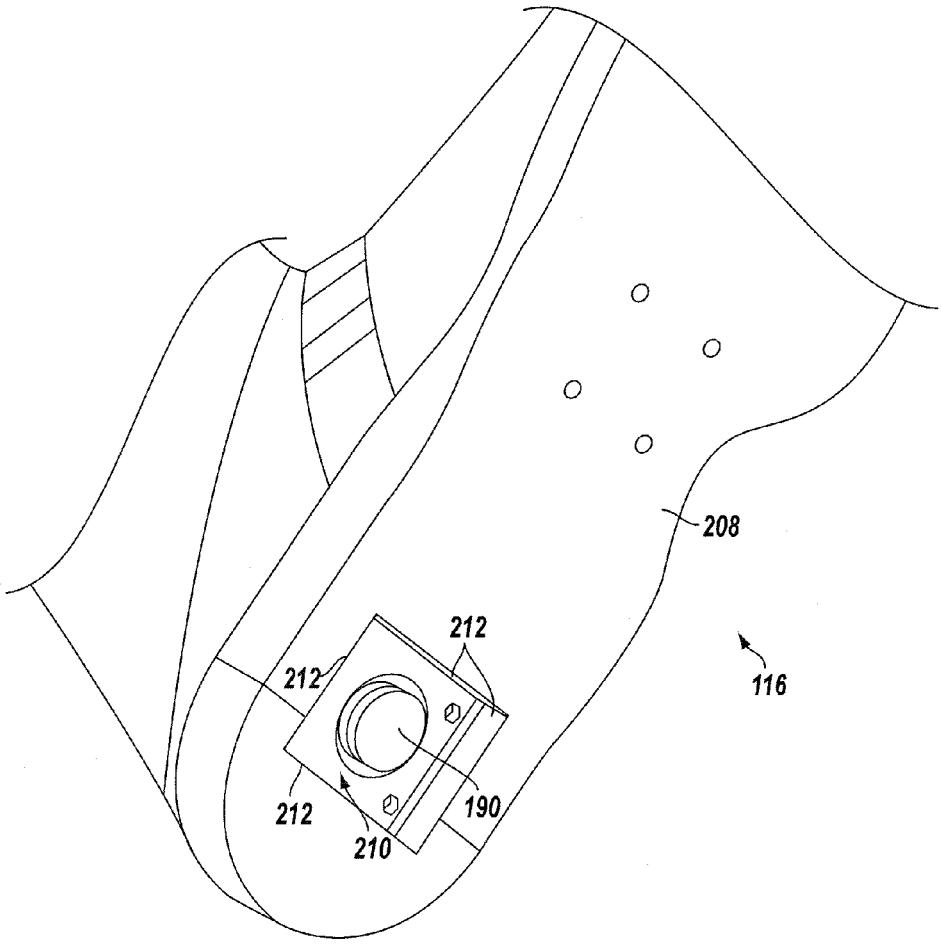
FIG. 13 is a perspective view of an embodiment of a foot restraint configured for use with the wakeboard binding of FIG. 11.

Referring to FIG. 13, a perspective view of an embodiment of a foot restraint 116 configured for use with the wakeboard binding 114 of FIG. 11 is shown. The foot restraint 116 may include at least one mating member configured to selectively engage with and disengage from the first and second connection members 146 and 148 (see FIGS. 11 and 12) to attach the foot restraint 116 to and detach the foot restraint 116 from the wakeboard binding 114 (see FIGS. 11 and 12). For example, the foot restraint 116 may comprise a single, unitary mating member 190, which may be configured to engage with and disengage from the first and second connection members 146 and 148 (see FIGS. 11 and 12). The mating member 190 may be located at a heel portion of the foot restraint 116. A sole member 208 of the foot restraint 116 may define a mating cavity 210, which may comprise a generally cuboid, rectangular prism, or box shape in some embodiments, in which the unitary mating member 190 may be disposed. Mating sidewalls 212 defining the mating cavity 210 may abut against sidewalls 204 of the first and second connection members 146 and 148 (see FIGS. 11 and 12) to limit (e.g., prevent) relative rotational movement between the foot restraint 116 and the wakeboard binding 114 (see FIGS. 11 and 12).

Figure 14:
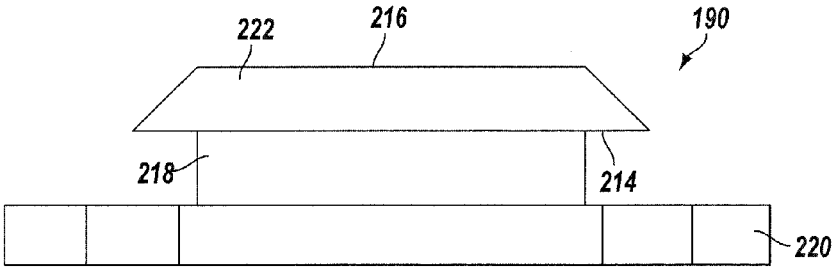
FIG. 14 is a side view of a unitary mating member of the foot restraint of FIG. 13.

Referring to FIG. 14, a side view of the unitary mating member 190 of the foot restraint 116 of FIG. 13 is shown. The unitary mating member 190 may comprise a mating ledge 214 which may engage with the overhanging ledges 202 of the first and second connection members 146 and 148 (see FIGS. 11 and 12) to limit (e.g., prevent) relative separation movement between the foot restraint 116 (see FIG. 13) and the wakeboard binding 114 (see FIGS. 11 and 12). The mating ledge 214 may be defined, for example, by an enlarged head 216 at an end of a cylindrical protrusion 218 extending from a base plate 220 of the unitary mating member 190. The enlarged head 216 may comprise a chamfered surface 222 that may be configured to cooperatively slide along the sloped surfaces 206 of the first and second connection members 146 and 148 (see FIGS. 11 and 12) as the foot restraint 116 (see FIG. 13) is brought into connection with the wakeboard binding 114 (see FIGS. 11 and 12). The base plate 220 may be configured for attachment to the sole member 208 of a foot restraint 116 (see FIGS. 11 and 12), for example, using screws, bolts, pins, etc.

A user wishing to use the wakeboard binding 114 and foot restraint 116 shown and described in connection with FIGS. 11 through 14 may be enabled to perform the sometimes difficult maneuvering required to put the foot restraint 116 on in a boat or otherwise before entering the water because the foot restraint 116 is configured to disconnect from the wakeboard binding 114. After donning the foot restraint 116, the user may simply align the heel portion of the foot restraint 116 with the first and second connection members 146 and 148 of the wakeboard binding 114 and step in to connect the foot restraint 116 to the wakeboard binding 114. As the user steps in, the chamfered surface 222 of the unitary mating member 190 may contact the sloped surfaces 206 of the first and second connection members 146 and 148, which may aid the user in aligning the unitary mating member 190 with the retaining cavity 200 defined by the first and second connection members 146 and 148, and which may cause the first connection member 146, the second connection member 148, or both to move from the connection position toward the release position. Moving toward the release position may cause the opening 224 to the retaining cavity 200 to increase in size to receive at least the enlarged head 216 of the unitary mating member 190 into the retaining cavity 200.

In some embodiments, the user may be required to move the release member 192 out of the connection groove 194 to enable the first connection member 146, the second connection member 148, or both to move from the connection position toward the release position. In other embodiments, the first connection member 146, the second connection member 148, or both may move from the connection position toward the release position in response to forces generated from forcing the chamfered surface 222 against the sloped surface 206 even if the release member 192 is in the connection groove 194, which may enable easier, hands-free operation of the wakeboard binding 114.

Once the enlarged head 216 of the unitary mating member 190 is fully disposed in the retaining cavity 200, the first connection member 146, the second connection member 148, or both may return to the connection position in response to a bias force (e.g., exerted by a spring) directed toward the connection position. Moving toward the connection position may cause the opening 224 to the retaining cavity 200 to decrease in size to close around the enlarged head 216 of the unitary mating member 190 and secure it within the retaining cavity 200. Separation of the foot restraint 116 from the wakeboard binding 114 may be limited (e.g., prevented) by mechanical interference between the overhanging ledges 202 of the first and second connection members 146 and 148 and the mating ledge 214 of the unitary mating member 190. In this way, the overhanging ledges 202 may longitudinally secure the mating ledge 214 to impede (e.g., prevent) unintentional longitudinal separation between the foot restraint 116 and the wakeboard binding 114.

To detach the foot restraint 116 from the wakeboard binding 114, the user may displace the release member 192 from the connection groove 194, move the first connection member 146, the second connection member 148, or both to the release position responsive to movement of the release member 192 away from the connection groove 194 toward the release groove 196, and lock the first and second connection members 146 and 148 in the release position by disposing the release member 192 in the release groove 196. The overhanging ledge 202 may disengage from the mating ledge 214, and the unitary mating member 190 may be extracted from the retaining cavity 200 as the foot restraint 116 is separated from the wakeboard binding 114. In this way, a user wearing the foot restraint 116 may easily and safely step into and out of the wakeboard binding 114.

Figure 15:
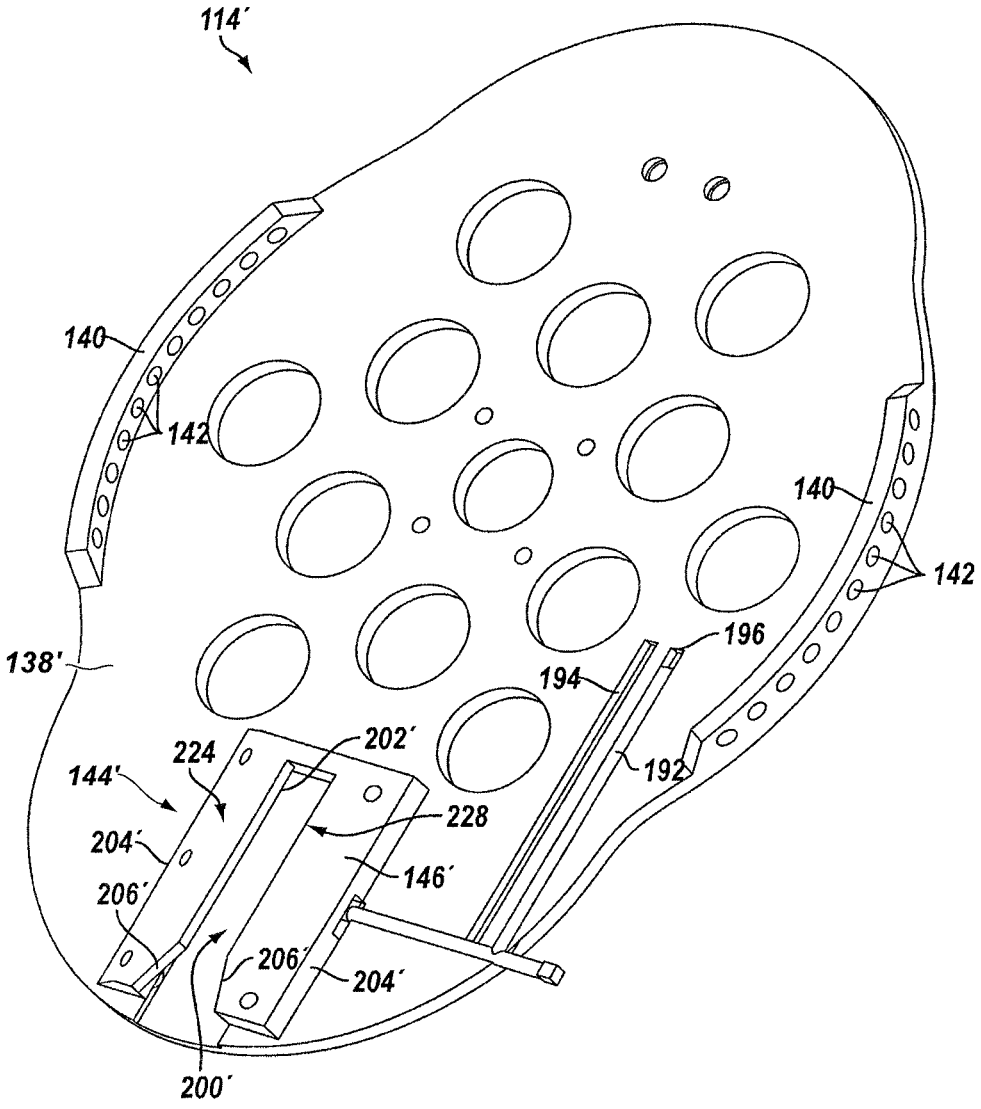
FIG. 15 is a perspective view of yet another embodiment of a wakeboard binding.

Referring to FIG. 15, a perspective view of yet another embodiment of a wakeboard binding 114' is shown. For the sake of simplicity, a first member of the wakeboard binding 114' to which a second member 138' may be rotatably connected is not shown, though such a first member may be at least substantially similar to that described in connection with FIGS. 3 through 6. The wakeboard binding 114' may include a releasable step-in connection device 144' configured to selectively retain a foot restraint 116' (see FIG. 17) secured to the second member 138' of the wakeboard binding 114', which may define a single location of attachment for the foot restraint 116' (see FIG. 17) to the wakeboard binding 114' in some embodiments. In other embodiments, the wakeboard binding 114' may comprise another connection member, similar to the first connection member 46 described previously in connection with FIGS. 4 through 6 and 10, to define another location of attachment for the foot restraint 116'. The releasable step-in connection device 144' may be movable between a release state, as shown in FIGS. 15 and 16, and a connection state (not shown), which are described more particularly in connection with FIG. 16.

The releasable step-in connection device 144' may comprise a first connection member 146' defining a retaining cavity 200' in which at least a portion of at least one mating member (e.g., a unitary mating member 190' (see FIGS. 17 and 18)) may be disposed when a foot restraint 116' (see FIG. 17) is attached to the wakeboard binding 114'. For example, the first connection member 146' may comprise an overhanging ledge 202' with which a mating member 190' (see FIGS. 17 and 18) may engage and which may limit (e.g., prevent) separation movement between a foot restraint 116' (see FIG. 17) and the wakeboard binding 114'. A slot 228 defined by the first connection member 146', through which a mating member 190' (see FIGS. 17 and 18) may extend into the retaining cavity 200', may define a generally rectangular shape in some embodiments. The overhanging ledge 202' may comprise a sloped surface 206' partially defining the slot 228, which may enable easier alignment of the mating member 190' (see FIGS. 17 and 18) with the slot 228 and retaining cavity 200'. The first connection member 146' may further comprise at least one sidewall 204' with which a mating member 190' (see FIGS. 17 and 18) or a foot restraint 116' (see FIG. 17) may engage and which may limit (e.g., prevent) rotational movement between the foot restraint 116' (see FIG. 17) and the wakeboard binding 114'.

In some embodiments, the releasable step-in connection device 144' may be releasably locked into the connection and release states. For example, a release member 192 may be disposed in a connection groove 194 to impede (e.g., prevent) the releasable step-in connection device 144' from unintentionally moving from the connection state to the release state. The release member 192 may be disposed in a release groove 196 to impede (e.g., prevent) the releasable step-in connection device 144' from unintentionally moving from the release state to the connection state. For example, the release member 192 may be biased toward the connection and release grooves 194 and 196 (e.g., by a spring) such that freeing the release member 192 from the user's grasp causes the release member 192 to enter a respective groove 194 or 196 with which it is aligned. Such a configuration may enable a user to more easily ensure that the foot restraint 116' (see FIG. 17) does not become detached from the wakeboard binding 114' when the user desires to remain connected to the wakeboard binding 114' (e.g., while wakeboarding) and to impede (e.g., prevent) the releasable step-in connection device 144' from returning to the connection state before the user has detached the foot restraint 116' (see FIG. 17) from the wakeboard binding 114'.

Figure 16:
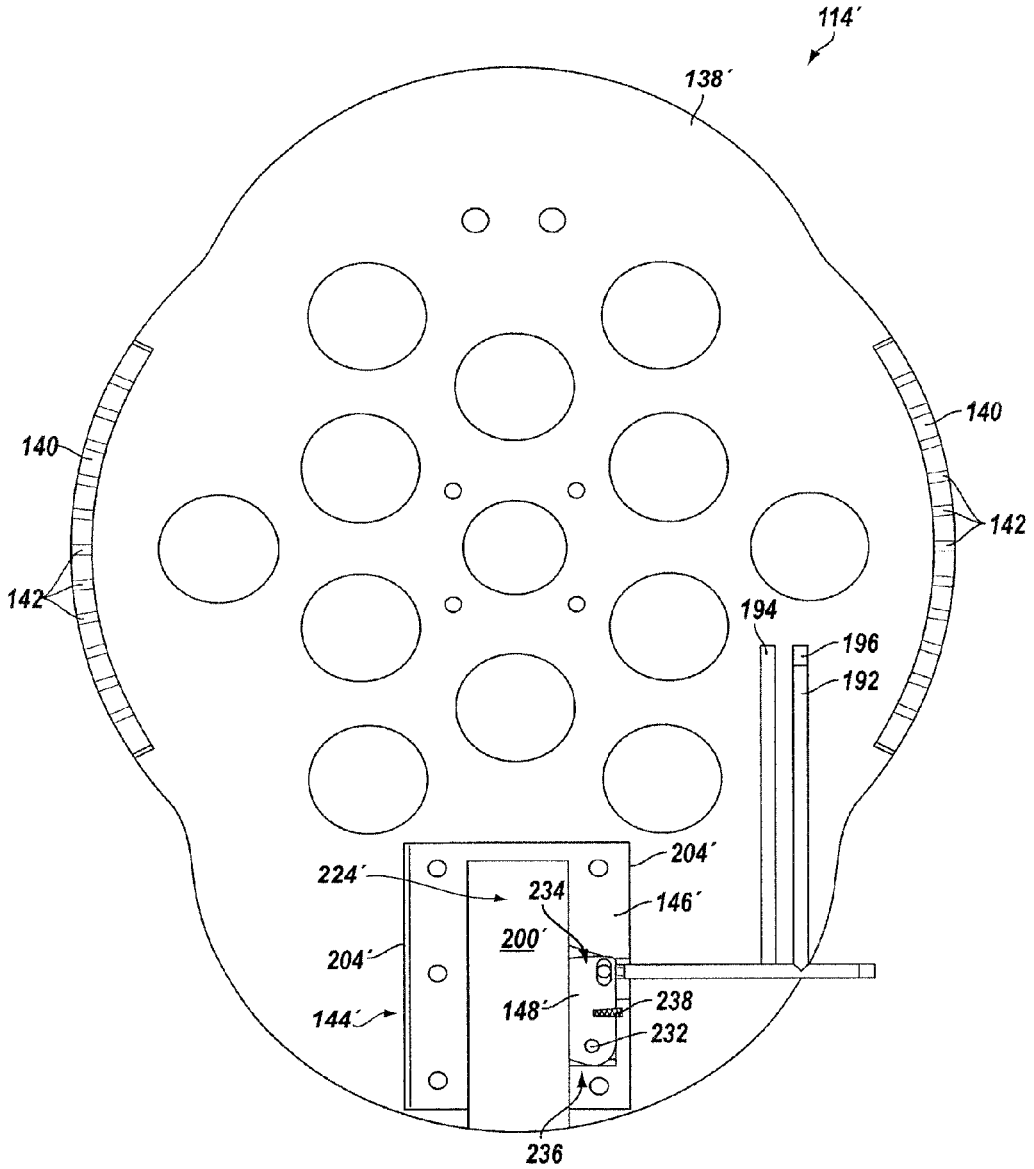
FIG. 16 is a cross-sectional top view of the wakeboard binding of FIG. 15.

Referring to FIG. 16, a cross-sectional top view of the wakeboard binding 114' of FIG. 15 is shown. The releasable step-in connection device 144' may comprise a second connection member 148' configured to selectively retain and release a foot restraint 116'. In a connection position of the second connection member 148' (corresponding to a connection state of the releasable step-in connection device 144'), the second connection member 148' may extend into the retaining cavity 200' to constrain movement of at least one mating member (e.g., a unitary mating member 190' (see FIGS. 17 and 18)) and impede (e.g., prevent) separation of a foot restraint 116' (see FIG. 17) from the wakeboard binding 114'. When in the release position of the second connection member 148' (corresponding to the release state of the releasable step-in connection device 144'), the second connection member 148' may be moved out of the retaining cavity 200' to permit movement of at least one mating member and enable separation of a foot restraint 116' (see FIG. 17) from the wakeboard binding 114'.

The second connection member 148' may be movable with respect to the retaining cavity 200' to assume the connection and release positions. For example, the second connection member 148' may pivot about an axis 232 to dispose a distal end 234 of the second connection member 148' into the retaining cavity 200' and to remove the distal end 234 of the second connection member 148' from the retaining cavity 200'. To move the second connection member 148' from the connection position to the release position, a user may grasp a release member 192 connected to the second connection member 148' and exert a force on the release member 192 directed away from the retaining cavity 200' from the perspective of the second connection member 148'. For example, a user may grasp a release member 192 comprising a lever and pull it laterally away from the second connection member 148' to move the second connection member 148' (e.g., within a space 236 defined by the first connection member 146' in which the connection member 236 is disposed) into the release position. The second connection member 148' may be biased toward the connection position, for example, by a spring 238. Accordingly, the second connection member 148' may return to the connection position by freeing the release member 192 and allowing the second connection member 148' to return to the connection position. In other embodiments, the second connection member 148' may be linearly displaced to assume the release and connection positions.

Figure 17:
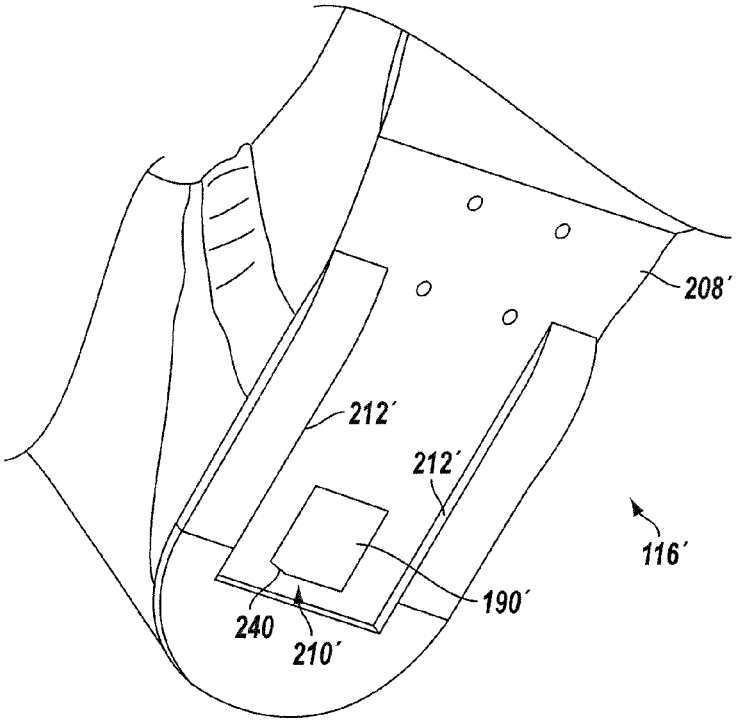
FIG. 17 is a perspective view of an embodiment of a foot restraint configured for use with the wakeboard binding of FIG. 15.

Referring to FIG. 17, a perspective view of an embodiment of a foot restraint 116' configured for use with the wakeboard binding 114' of FIG. 15 is shown. The foot restraint 116' may include at least one mating member configured to selectively engage with and disengage from the first and second connection members 146' and 148' (see FIGS. 15 and 16) to attach the foot restraint 116' to and detach the foot restraint 116' from the wakeboard binding 114' (see FIGS. 15 and 16). For example, the foot restraint 116' may comprise a single, unitary mating member 190', which may be configured to engage with and disengage from the first and second connection members 146' and 148' (see FIGS. 15 and 16). The mating member 190' may be located at a heel portion of the foot restraint 116'. A sole member 208' of the foot restraint 116' may define a mating cavity 210', which may comprise a three-sided generally cuboid, rectangular prism, or box shape in some embodiments, in which the unitary mating member 190' may be disposed. Mating sidewalls 212' defining the mating cavity 210' may abut against sidewalls 204' of the first connection member 146' (see FIGS. 15 and 16) to limit (e.g., prevent) relative rotational movement between the foot restraint 116' and the wakeboard binding 114' (see FIGS. 15 and 16).

Figure 18:
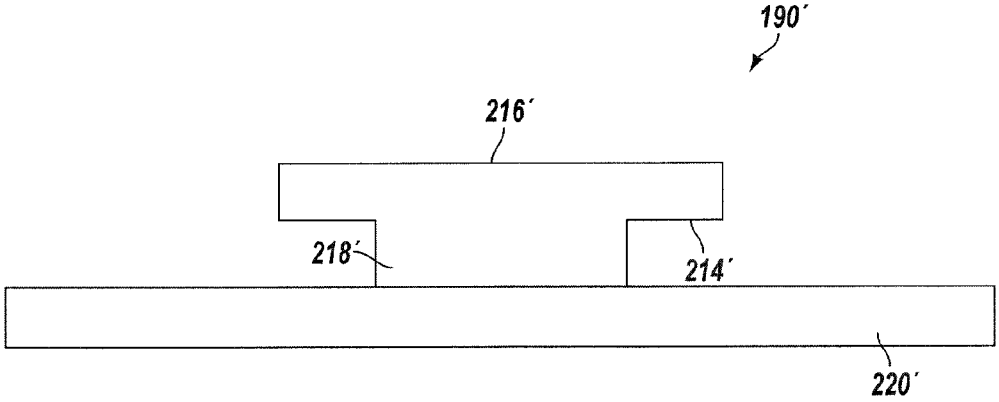
FIG. 18 is a top view of a unitary mating member of the foot restraint of FIG. 17.

Referring to FIG. 18, a top view of a unitary mating member 190' of the foot restraint 116' of FIG. 17 is shown. The unitary mating member 190' may comprise a mating ledge 214' which may engage with the overhanging ledges 202' of the first connection member 146' (see FIGS. 15 and 16) to limit (e.g., prevent) relative separation movement between the foot restraint 116' (see FIG. 17) and the wakeboard binding 114' (see FIGS. 15 and 16). The mating ledge 214' may be defined, for example, by an enlarged head 216' at an end of a generally cuboid protrusion 218' extending from a base plate 220' of the unitary mating member 190'. The enlarged head 216' may comprise an angled surface 240 which may be configured to cooperatively engage with (e.g., contact or abut against) the distal end 234 of the second connection member 148' (see FIG. 16) as the foot restraint 116' (see FIG. 17) is brought into connection with the wakeboard binding 114' (see FIGS. 15 and 16). The base plate 220' may be configured for attachment to the sole member 208' of a foot restraint 116' (see FIG. 17), for example, using screws, bolts, pins, etc.

A user wishing to use the wakeboard binding 114' and foot restraint 116' shown and described in connection with FIGS. 15 through 18 may be enabled to perform the sometimes difficult maneuvering required to put the foot restraint 116' on in a boat or otherwise before entering the water because the foot restraint 116' is configured to disconnect from the wakeboard binding 114'. After donning the foot restraint 116', the user may simply align the heel portion of the foot restraint 116' with the first connection member 146' of the wakeboard binding 114' and slide the foot restraint forward (i.e., in a direction from heel to toe) to connect the foot restraint 116' to the wakeboard binding 114'. As the user slides the foot restraint 116' forward, the protrusion 218' of the unitary mating member 190' may contact the sloped surfaces 206' of the first connection member 146', which may aid the user in aligning the unitary mating member 190' with the retaining cavity 200' defined by the first connection member 146'. The enlarged head 216' of the unitary mating member 190' may contact the distal end 234 of the second connection member 148', which may cause the second connection member 148' to pivot from the connection position toward the release position.

In some embodiments, the user may be required to move the release member 192 out of the connection groove 194 to enable the second connection member 148' to pivot from the connection position toward the release position. In other embodiments, the second connection member 148' may pivot from the connection position toward the release position in response to forces generated from forcing the enlarged head 216' against the distal end 234 of the second connection member 148' even if the release member 192 is in the connection groove 194, which may enable easier, hands-free operation of the wakeboard binding 114'.

Once the enlarged head 216' of the unitary mating member 190' is fully inserted into the retaining cavity 200', the second connection member 148' may return to the connection position in response to a bias force (e.g., exerted by the spring 238) directed toward the connection position. Separation of the foot restraint 116' from the wakeboard binding 114' may be limited (e.g., prevented) by mechanical interference between the overhanging ledges 202' of the first connection member 146', the distal end 234 of the second connection member 148' and the mating ledge 214' of the unitary mating member 190'. In this way, the overhanging ledge 202' is configured to longitudinally secure the mating ledge 214' of the enlarged head 216', and the distal end 234 is configured to secure the enlarged head 216' within the retaining cavity 200'. To detach the foot restraint 116' from the wakeboard binding 114', the user may displace the release member 192 from the connection groove 194, move the second connection member 148' to the release position responsive to movement of the release member 192 away from the connection groove 194 toward the release groove 196, and lock the second connection member 148' in the release position by disposing the release member 192 in the release groove 196. The enlarged head 216 may disengage from the distal end 234 of the second connection member 148', and the unitary mating member 190' may be extracted from the retaining cavity 200' as the foot restraint 116' is slid backward (i.e., in a direction from toe to heel) away from the wakeboard binding 114'. In this way, a user wearing the foot restraint 116' may easily and safely slide into and out of the wakeboard binding 114'.

Additional, non-limiting embodiments within the scope of the disclosure include:

Embodiment 1

A wakeboard binding may comprise a first member configured for connection to a wakeboard; at least one selective retaining device comprising at least one retaining member biased toward a rotation-precluding position and movable to a rotation-permitting position connected to the first member and disposed at a periphery of the first member; a second member rotatable with respect to the first member comprising at least one engagement member adjacent the selective retaining device, wherein the at least one retaining member is engaged with the at least one engagement member to preclude rotation of the second member in the rotation-precluding position and the at least one retaining member is disengaged from the at least one engagement member to permit rotation of the second member in the rotation-permitting position; and a releasable step-in connection device comprising a first connection member and a second connection member biased toward a connection position and movable to a release position connected to the second member and configured to releasably connect to a foot restraint.

Embodiment 2

The wakeboard binding of Embodiment 1, wherein the at least one selective retaining device comprises at least two selective retaining devices disposed on opposing sides of the periphery of the first member and flanking the releasable step-in connection device.

Embodiment 3

The wakeboard binding of Embodiment 1 or Embodiment 2, wherein the at least one engagement member comprises a plurality of retaining holes, each retaining hole corresponding to an angular position of the second member with respect to the first member, and the at least one retaining member comprises at least one pin biased toward insertion into at least one retaining hole of the plurality of retaining holes in the rotation-precluding position and withdrawn from the at least one retaining hole of the plurality of retaining holes in the rotation-permitting position.

Embodiment 4

The wakeboard binding of any one of Embodiments 1 through 3, wherein the first connection member of the releasable step-in connection device comprises a ledge configured to longitudinally secure a protrusion at a toe portion of the foot restraint and the second connection member comprises a latch configured to engage with a surface defining a recess at a heel portion of the foot restraint in the connection position and to disengage from the recess at the heel portion of the foot restraint in the release position.

Embodiment 5

The wakeboard binding of any one of Embodiments 1 through 3, wherein each of the first connection member and the second connection member of the releasable step-in connection device comprises an overhanging ledge configured to longitudinally secure a mating ledge of an oversized head of a unitary mating member at a heel portion of the foot restraint, wherein the first connection member and the second connection member cooperatively define a retaining cavity in which the oversized head is configured to be received and wherein the first connection member, the second connection member, or both is configured to move to increase a size of an opening to the retaining cavity in the release position and to decrease the size of the opening to the retaining cavity in the connection position.

Embodiment 6

The wakeboard binding of any one of Embodiments 1 through 3, wherein the first connection member comprises an overhanging ledge defining a slot configured to slidably receive a unitary mating member at a heel portion of the foot restraint and the second connection member comprises a distal end configured to secure an enlarged head of the unitary mating member, wherein the overhanging ledge is configured to longitudinally secure a mating ledge of the enlarged head, and wherein the second connection member is configured to pivot into a retaining cavity defined by the first connection member in the connection position and to pivot out of the retaining cavity in the release position.

Embodiment 7

The wakeboard binding of any one of Embodiments 1 through 6, wherein a distance between a bottom surface of the wakeboard binding and an uppermost portion of the wakeboard binding is about 1 inch (2.54 cm).

Embodiment 8

The wakeboard binding of any one of Embodiments 1 through 7, wherein the second member and the at least one engagement member comprise a single, integrally formed unit.

Embodiment 9

The wakeboard binding of any one of Embodiments 1 through 8, wherein mechanical interference between the first member and the second member precludes longitudinal separation of the second member from the first member.

Embodiment 10

The wakeboard binding of any one of Embodiments 1 through 9, wherein at least a portion of the second member is located in the same horizontal plane as at least a portion of the first member.

Embodiment 11

The wakeboard binding of any one of Embodiments 1 through 10, wherein the second member is rotatable with respect to the first member over an included rotation angle of about 60°.

Embodiment 12

The wakeboard binding of any one of Embodiments 1 through 11, wherein the first member and the second member are at least substantially composed of at least one of a polymer material, a metal material, and a metal alloy material.

Embodiment 13

A wakeboard assembly, comprising: a wakeboard; and at least one wakeboard binding attached to the wakeboard comprising: a first member connected to the wakeboard; a selective retaining device comprising at least one retaining member biased toward a rotation-precluding position and movable to a rotation-permitting position connected to the first member and disposed at a periphery of the first member; a second member rotatable with respect to the first member comprising at least one engagement member adjacent the selective retaining device, wherein the at least one retaining member is engaged with the at least one engagement member to preclude rotation of the second member in the rotation-precluding position and the at least one retaining member is disengaged from the at least one engagement member to permit rotation of the second member in the rotation-permitting position; and a releasable step-in connection device comprising a first connection member and a second connection member biased toward a connection position and movable to a release position connected to the second member and configured to releasably connect to a foot restraint.

Embodiment 14

The wakeboard assembly of Embodiment 13, further comprising a foot restraint releasably connected to the releasable step-in connection device.

Embodiment 15

The wakeboard assembly of Embodiment 14, wherein the foot restraint comprises a first mating member configured to be longitudinally secured by the first connection member and a second mating member configured to be releasably longitudinally secured by the second connection member and comprises one of a conventional wakeboard binding, a boot, and a skeleton structure attached to conventional footwear.

Embodiment 16

The wakeboard assembly of Embodiment 14, wherein the foot restraint includes a unitary mating member configured to be cooperatively longitudinally secured by the first connection member and the second connection member, wherein the foot restraint comprises one of a conventional wakeboard binding, a boot, and a skeleton structure attached to conventional footwear.

Embodiment 17

The wakeboard assembly of Embodiment 14 or Embodiment 15, wherein the selective retaining device comprises a plurality of retaining members disposed on opposing sides of the periphery of the first member and flanking the foot restraint.

Embodiment 18

The wakeboard assembly of any one of Embodiments 13 through 17, wherein the at least one engagement member comprises a plurality of holes, each hole corresponding to an angular position of the second member with respect to the first member, and the at least one retaining member comprises at least one pin biased toward insertion into at least one hole of the plurality of holes in the rotation-precluding position and removed from the at least one hole of the plurality of holes in the rotation-permitting position.

Embodiment 19

The wakeboard assembly of any one of Embodiments 13 through 18, wherein a distance between a bottom surface of the at least one wakeboard binding and an uppermost portion of the at least one wakeboard binding is about 1 inch (2.54 cm).

Embodiment 20

The wakeboard binding of any one of Embodiments 13 through 19, wherein the second member is rotatable with respect to the first member over an included rotation angle of about 45°.

Embodiment 21

A method of positioning a foot restraint on a wakeboard binding, comprising: releasably connecting a foot restraint to a releasable step-in connection device; and adjusting an angular orientation of the foot restraint while the foot restraint is releasably connected to the releasable step-in connection device, comprising: disengaging at least one retaining member from at least one engagement member located laterally adjacent the foot restraint; rotating the foot restraint; and engaging the at least one retaining member with the at least one engagement member.

Embodiment 22

The method of Embodiment 21, wherein releasably connecting the foot restraint to the releasable step-in connection device comprises: engaging a first mating member at a toe portion of the foot restraint with a first connection member of the releasable step-in connection device; lowering a heel portion of the foot restraint toward the releasable step-in connection device; and engaging a second mating member at a heel portion of the foot restraint with a second connection member biased toward a connection position and movable to a release position.

Embodiment 23

The method of Embodiment 21, wherein releasably connecting the foot restraint to the releasable step-in connection device comprises: contacting a unitary mating member at a heel portion of the foot restraint against a first connection member and a second connection member of the releasable step-in connection device to increase a size of an opening to a retaining cavity cooperatively defined by the first connection member and the second connection member by moving the second connection member from a connection position toward a release position; lowering the heel portion of the foot restraint toward the retaining cavity to insert an enlarged head of the unitary mating member into the retaining cavity; and decreasing the size of the opening to the retaining cavity to engage a mating ledge defined by the enlarged head with an overhanging ledge of each of the first connection member and the second connection member by moving the second connection member from the release position toward the connection position.

Embodiment 24

The method of Embodiment 23, wherein moving the second connection member from the release position toward the connection position comprises moving the second connection member from the release position toward the connection position responsive to a bias force biasing the second connection member toward the connection position.

Embodiment 25

The method of Embodiment 21, wherein releasably connecting the foot restraint to the releasable step-in connection device comprises contacting a unitary mating member at a heel portion of the foot restraint against a first connection member comprising an overhanging ledge defining a retaining cavity; sliding an enlarged head of the unitary mating member under the overhanging ledge toward the retaining cavity to insert the enlarged head into the retaining cavity and engage a mating ledge defined by the enlarged head with the overhanging ledge; pivoting a second connection member from a connection position toward a release position responsive to insertion of the enlarged head into the retaining cavity; and pivoting the second connection member from the release position toward the connection position to engage a distal end of the second connection member with the enlarged head to secure the enlarged head within the retaining cavity.

Embodiment 26

The method of Embodiment 25, wherein pivoting the second connection member from the release position toward the connection position comprises pivoting the second connection member from the release position toward the connection position responsive to a bias force biasing the second connection member toward the connection position.

Embodiment 27

The method of any one of Embodiments 21 through 26, wherein disengaging the at least one retaining member from the at least one engagement member located adjacent the foot restraint comprises retracting at least one pin biased toward insertion into at least one hole in the at least one engagement member from the at least one hole in the at least one engagement member and wherein engaging the at least one retaining member with the at least one engagement member comprises inserting the at least one pin into at least another hole in the at least one engagement member.

Embodiment 28

The method of any one of Embodiments 21 through 27, wherein releasably connecting the foot restraint to the releasable step-in connection device comprises releasably connecting one of a conventional wakeboard binding, a boot, and a skeleton structure attached to conventional footwear to the releasable step-in connection device.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of the disclosure, as contemplated by the inventors.

What is claimed is:

1. A wakeboard binding, comprising:

a first member configured for connection to a wakeboard;

at least one selective retaining device comprising at least one retaining member biased toward a rotation-precluding position and movable to a rotation-permitting position connected to the first member and disposed at a periphery of the first member;

a second member rotatable with respect to the first member comprising at least one engagement member adjacent the at least one selective retaining device, wherein the at least one retaining member is engaged with the at least one engagement member to preclude rotation of the second member in the rotation-precluding position and the at least one retaining member is disengaged from the at least one engagement member to permit rotation of the second member in the rotation-permitting position; and a releasable step-in connection device comprising a first connection member and a second connection member biased toward a connection position and movable to a release position connected to the second member and configured to releasably connect to a foot restraint.

2. The wakeboard binding of claim 1, wherein the at least one selective retaining device comprises at least two selective retaining devices disposed on opposing sides of the periphery of the first member and flanking the releasable step-in connection device.

3. The wakeboard binding of claim 1, wherein the at least one engagement member comprises a plurality of retaining holes, each retaining hole corresponding to an angular position of the second member with respect to the first member, and the at least one retaining member comprises at least one pin biased toward insertion into at least one retaining hole of the plurality of retaining holes in the rotation-precluding position and withdrawn from the at least one retaining hole of the plurality of retaining holes in the rotation-permitting position.

4. The wakeboard binding of claim 1, wherein each of the first connection member and the second connection member of the releasable step-in connection device comprises an overhanging ledge configured to longitudinally secure a mating ledge of an oversized head of a unitary mating member at a heel portion of the foot restraint, wherein the first connection member and the second connection member cooperatively define a retaining cavity in which the oversized head is configured to be received and wherein the first connection member, the second connection member, or both is configured to move to increase a size of an opening to the retaining cavity in the release position and to decrease the size of the opening to the retaining cavity in the connection position.

5. The wakeboard binding of claim 1, wherein the first connection member comprises an overhanging ledge defining a slot configured to slidably receive a unitary mating member at a heel portion of the foot restraint and the second connection member comprises a distal end configured to secure an enlarged head of the unitary mating member, wherein the overhanging ledge is configured to longitudinally secure a mating ledge of the enlarged head, and wherein the second connection member is configured to pivot into a retaining cavity defined by the first connection member in the connection position and to pivot out of the retaining cavity in the release position.

6. The wakeboard binding of claim 1, wherein a distance between a bottom surface of the wakeboard binding and an uppermost portion of the wakeboard binding is about 1 inch (2.54 cm).

7. The wakeboard binding of claim 1, wherein the second member and the at least one engagement member comprise a single, integrally formed unit.

8. The wakeboard binding of claim 1, wherein mechanical interference between the first member and the second member precludes longitudinal separation of the second member from the first member.

9. The wakeboard binding of claim 1, wherein at least a portion of the second member is located in the same horizontal plane as at least a portion of the first member.

10. The wakeboard binding of claim 1, wherein the second member is rotatable with respect to the first member over an included rotation angle of about 60°.

11. The wakeboard binding of claim 1, wherein the first member and the second member are at least substantially composed of at least one of a polymer material, a metal material, and a metal alloy material.

12. A wakeboard assembly, comprising:

a wakeboard; and at least one wakeboard binding attached to the wakeboard comprising:

a first member connected to the wakeboard;

a selective retaining device comprising at least one retaining member biased toward a rotation-precluding position and movable to a rotation-permitting position connected to the first member and disposed at a periphery of the first member;

a second member rotatable with respect to the first member comprising at least one engagement member adjacent the selective retaining device, wherein the at least one retaining member is engaged with the at least one engagement member to preclude rotation of the second member in the rotation-precluding position and the at least one retaining member is disengaged from the at least one engagement member to permit rotation of the second member in the rotation-permitting position; and a releasable step-in connection device comprising a first connection member and a second connection member biased toward a connection position and movable to a release position connected to the second member and configured to releasably connect to a foot restraint.

13. The wakeboard assembly of claim 12, further comprising a foot restraint releasably connected to the releasable step-in connection device.

14. The wakeboard assembly of claim 13, wherein the foot restraint includes a unitary mating member configured to be cooperatively longitudinally secured by the first connection member and the second connection member, wherein the foot restraint comprises one of a conventional wakeboard binding, a boot, and a skeleton structure attached to conventional footwear.

15. The wakeboard assembly of claim 13, wherein the selective retaining device comprises a plurality of retaining members disposed on opposing sides of the periphery of the first member and flanking the foot restraint.

16. The wakeboard assembly of claim 12, wherein the at least one engagement member comprises a plurality of holes, each hole corresponding to an angular position of the second member with respect to the first member, and the at least one retaining member comprises at least one pin biased toward insertion into at least one hole of the plurality of holes in the rotation-precluding position and removed from the at least one hole of the plurality of holes in the rotation-permitting position.

17. The wakeboard assembly of claim 12, wherein a distance between a bottom surface of the at least one wakeboard binding and an uppermost portion of the at least one wakeboard binding is about 1 inch (2.54 cm).

18. The wakeboard binding of claim 12, wherein the second member is rotatable with respect to the first member over an included rotation angle of about 45°.

19. A method of positioning a foot restraint on a wakeboard binding, comprising:

releasably connecting a foot restraint to a releasable step-in connection device; and adjusting an angular orientation of the foot restraint while the foot restraint is releasably connected to the releasable step-in connection device, comprising:

disengaging at least one retaining member from at least one engagement member located laterally adjacent the foot restraint by retracting at least one pin biased toward insertion into at least one hole in the at least one engagement member from the at least one hole in the at least one engagement member;

rotating the foot restraint; and engaging the at least one retaining member with the at least one engagement member by inserting the at least one pin into at least another hole in the at least one engagement member.

* * * * *